US007602355B2

(12) United States Patent
Lee et al.

(10) Patent No.: US 7,602,355 B2
(45) Date of Patent: Oct. 13, 2009

(54) PLASMA DISPLAY APPARATUS AND DRIVING METHOD THEREOF

(75) Inventors: Sung Im Lee, Gumi-si (KR); Ki-Duck Cho, Changwon-si (KR); Min Soo Kim, Gumi-si (KR); Kyoung Jin Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 687 days.

(21) Appl. No.: 11/289,500

(22) Filed: Nov. 30, 2005

(65) Prior Publication Data

US 2006/0114186 A1 Jun. 1, 2006

(30) Foreign Application Priority Data

Dec. 1, 2004 (KR) ..... 10-2004-0100057

(51) Int. Cl.
*G09G 3/28* (2006.01)

(52) U.S. Cl. ..... 345/60; 345/63; 345/65; 345/67; 345/69

(58) Field of Classification Search ..... 345/37, 345/41, 55, 60–72, 208, 211, 690, 204; 315/169.4, 315/169.3, 169.1; 313/581–587, 484, 491; 348/739

See application file for complete search history.

(56) References Cited

U.S. PATENT DOCUMENTS 6,011,355 A * 1/2000 Nagai ..... 315/169.3
7,012,579 B2 * 3/2006 Choi ..... 345/60
7,046,216 B2 * 5/2006 Lim et al. ..... 345/37
7,049,755 B2 * 5/2006 Kosaka ..... 315/169.4
7,321,346 B2 * 1/2008 Jung et al. ..... 345/68
7,342,557 B2 * 3/2008 Chung et al. ..... 345/60
7,365,710 B2 * 4/2008 Chung et al. ..... 345/60
7,479,952 B2 * 1/2009 Lee et al. ..... 345/204
2003/0107532 A1 * 6/2003 Choi ..... 345/60
2003/0189533 A1 * 10/2003 Myoung et al. ..... 345/67
2004/0012547 A1 * 1/2004 Lee ..... 345/60
2004/0239588 A1 * 12/2004 Nagao et al. ..... 345/60
2005/0052347 A1 * 3/2005 Chung et al. ..... 345/37
2005/0093781 A1 * 5/2005 Chae et al. ..... 345/66
2005/0110713 A1 * 5/2005 Chung et al. ..... 345/60

(Continued)

FOREIGN PATENT DOCUMENTS

CN 1674069 A 9/2005

OTHER PUBLICATIONS

Chinese Office Action dated Feb. 1, 2008.

*Primary Examiner*—Prabodh M Dharia
(74) *Attorney, Agent, or Firm*—KED & Associates, LLP

(57) ABSTRACT

The present invention relates to a plasma display panel, and more particularly, to a plasma display apparatus and driving method thereof, in which power consumption can be reduced and contrast can be improved, so that a high contrast image can be displayed. The plasma display apparatus according to the present invention comprises a scan electrode, a sustain electrode, and a controller for applying a rising waveform and a falling waveform to the scan electrode in a reset period of a first subfield of a frame and applying the falling waveform to the scan electrode when a first time elapses, after a first sustain voltage is applied to the scan electrode during a sustain period. The sustain electrode is applied with a second sustain voltage when a second time is elapsed, after the first sustain voltage is applied.

17 Claims, 13 Drawing Sheets

U.S. PATENT DOCUMENTS

2005/0140588 A1* 6/2005 Lee et al. ..... 345/63
2005/0168406 A1* 8/2005 Lee et al. ..... 345/60
2006/0007965 A1* 1/2006 Tankovich et al. ..... 372/10
2006/0139246 A1* 6/2006 Choi ..... 345/60
2008/0158103 A1* 7/2008 Chung et al. ..... 345/60
2008/0218440 A1* 9/2008 Chung et al. ..... 345/60

* cited by examiner

PLASMA DISPLAY APPARATUS AND DRIVING METHOD THEREOF

CROSS-REFERENCES TO RELATED APPLICATIONS

This Nonprovisional application claims priority under 35 U.S.C. § 119(a) on Patent Application No. 10-2004-0100057 filed in Republic of Korea on Dec. 1, 2004, the entire contents of which are hereby incorporated by reference.

FIELD OF THE INVENTION

The present invention relates to a plasma display panel, and more particularly, to a plasma display apparatus and driving method thereof, in which power consumption can be reduced and contrast can be improved, so that a high contrast image can be displayed.

BACKGROUND OF THE RELATED ART

A plasma display panel (hereinafter referred to as a "PDP") displays images including characters or graphics by light-emitting phosphors with ultraviolet of 147 nm generated during the discharge of a mixed inert gas such as He+Xe, Ne+Xe or He+Ne+Xe. This PDP can be easily made thin and large, and it can provide greatly increased image quality with the recent development of the relevant technology. More particularly, a three-electrode AC surface discharge type PDP has advantages of lower voltage driving and longer product lifespan since wall charges are accumulated on a surface upon discharge and electrodes are protected from sputtering generated by a discharge.

FIG. 1 is a perspective view illustrating the structure of a discharge cell of a three-electrode AC surface discharge type PDP in the related art.

Referring to FIG. 1, the discharge cell of the three-electrode AC surface discharge type PDP comprises scan electrodes Y and sustain electrodes Z formed on a bottom surface of an upper substrate 10, and address electrodes X formed on a lower substrate 18. The scan electrode Y comprises a transparent electrode 12Y, and a metal bus electrode 13Y, which has a line width smaller than that of the transparent electrode 12Y and is disposed at one side edge of the transparent electrode. Furthermore, the sustain electrode Z comprises a transparent electrode 12Z, and a metal bus electrode 13Z, which has a line width smaller than that of the transparent electrode 12Z and is disposed at one side edge of the transparent electrode.

The transparent electrodes 12Y, 12Z are generally formed of Indium Tin Oxide (ITO) and are formed on a bottom surface of the upper substrate 10. The metal bus electrodes 13Y, 13Z are generally formed of metal such as chromium (Cr) and are formed on the transparent electrodes 12Y, 12Z. The metal bus electrodes 13Y, 13Z serve to reduce a voltage drop caused by the transparent electrodes 12Y, 12Z having high resistance. On the bottom surface of the upper substrate 10 in which the scan electrodes Y and the sustain electrodes Z are formed parallel to each other is laminated an upper dielectric layer 14 and a protection layer 16. Wall charges generated during the discharge of plasma are accumulated on the upper dielectric layer 14. The protection layer 16 functions to prevent the upper dielectric layer 14 from being damaged by sputtering generated during the discharge of plasma and also to improve emission efficiency of secondary electrons. Magnesium oxide (MgO) is generally used as the protection layer 16.

A lower dielectric layer 22 and barrier ribs 24 are formed on the lower substrate 18 in which the address electrodes X are formed. A phosphor layer 26 is coated on the surfaces of the lower dielectric layer 22 and the barrier ribs 24. The address electrodes X are formed to cross the scan electrodes Y and the sustain electrodes Z. The barrier ribs 24 are formed parallel to the address electrodes X and function to prevent ultraviolet generated by a discharge and a visible ray from leaking to neighboring discharge cells. The phosphor layer 26 is excited with an ultraviolet generated during the discharge of plasma to generate any one visible ray of red, green and blue. An inert mixed gas is injected into discharge spaces provided between the upper substrate 10 and the barrier ribs 24 and between the lower substrate 18 and the barrier ribs 24.

The PDP is time driven with one frame being divided into several subfields having a different number of emissions in order to implement gray levels of an image. Each of the sub fields is divided into a reset period for initializing the entire screen, an address period for selecting a scan line and selecting a cell from the selected scan line, and a sustain period for implementing gray levels according to a discharge number.

The reset period is divided into a set-up period where a ramp-up waveform is applied, and a set-down period where a ramp-down waveform is applied. For example, if it is sought to display an image with 256 gray levels, a frame period (16.67 ms) corresponding to 1/60 seconds is divided into eight subfields (SF1 to SF8), as shown in FIG. 2. Each of the subfields (SF1 to SF8) is divided into a reset period, an address period and a sustain period as described above. The reset period and the address period of each of the subfields (SF1 to SF8) are the same every subfield, whereas the sustain period is increased in the ratio of $2^n$ (where, n=0, 1, 2, 3, 4, 5, 6, 7) in each subfield.

FIG. 3 shows a waveform for illustrating a method of driving a PDP in the related art.

Referring to FIG. 3, the PDP is driven with one frame being divided into a reset period for initializing the entire screen, an address period for selecting a cell, and a sustain period for sustaining the discharge of a selected cell.

In a set-up period of the reset period, a ramp-up waveform (Ramp-up) is applied to the entire scan electrodes Y at the same time. The ramp-up waveform (Ramp-up) causes a weak discharge to be generated in the cells of the entire screen, so that wall charges are generated in the cells. In a set-down period, after the ramp-up waveform (Ramp-up) is applied, a ramp-down waveform (Ramp-down), which falls from a positive (+) voltage lower than a peak voltage of the ramp-up waveform (Ramp-up), is applied to the scan electrodes Y at the same time. The ramp-down waveform (Ramp-down) generates a weak erase discharge within the cells, thus erasing unnecessary charges, such as wall charges generated by the set-up discharge and spatial discharges, and causing wall charges necessary for an address discharge to uniformly remain within the cells.

In the address period, while a negative (−) scan pulse is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within the cells to which the data pulse (Data) is applied. Wall charges are generated within cells selected by the address discharge.

Meanwhile, during the set-down period and the address period, a positive (+) sustain voltage (Vs) is applied to the sustain electrodes Z.

In the sustain period, a sustain pulse (Sus) is alternately applied to the scan electrodes Y and the sustain electrodes Z.

A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. Lastly, after the sustain discharge is finished, an erase ramp waveform (erases) having a narrow pulse width is applied to the sustain electrodes Z, thus erasing wall charges within the cells.

In the method of driving the PDP in the related art, however, loss of power is consumed because the ramp-up waveform (Ramp-up) having a high voltage value must be applied to the scan electrodes Y every subfield. Furthermore, a large amount of light is generated by the ramp-up waveform (Ramp-up) applied to the scan electrodes Y during the reset period, which results in lowered contract. Therefore, a problem arises because a high contrast image cannot be displayed.

SUMMARY OF THE INVENTION

Accordingly, an object of the present invention is to solve at least the problems and disadvantages of the background art.

It is an object of the present invention to a method of driving a PDP, in which it can reduce power consumption can improve contrast, thus displaying a high contrast image.

A plasma display apparatus according to an aspect of the present invention comprises a scan electrode, a sustain electrode, and a controller for applying a rising waveform and a falling waveform to the scan electrode in a reset period of a first subfield of a frame and applying the falling waveform to the scan electrode when a first time elapses, after a first sustain voltage is applied to the scan electrode during a sustain period. The sustain electrode is applied with a second sustain voltage when a second time is elapsed, after the first sustain voltage is applied.

A method of driving a PDP according to an aspect of the present invention comprises the steps of, applying a rising waveform and a falling waveform to a scan electrode in a reset period of a first subfield of a frame, applying the falling waveform to the scan electrode when a first time elapses, after a first sustain voltage is applied to the scan electrode during a sustain period, and applying a second sustain voltage to the sustain electrode when a second time is elapsed, after the first sustain voltage is applied.

In the present invention, a ramp-up waveform having a set-up voltage is applied to scan electrodes only in a reset period of a first subfield of each frame, and an off-cell control pulse having a voltage lower than the set-up voltage is applied to the scan electrodes in a reset period of a $n^{th}$ (n is an integer greater than 2) subfield of the remaining subfields. This can lower the amount of light generated by the ramp-up waveform and can improve contrast.

Furthermore, in the present invention, since the ramp-up waveform is applied to the scan electrodes only in the reset period of the first subfield of each frame, power consumption incurred by the ramp-up waveform can be lowered. In addition, in the present invention, a peak voltage of an off-cell control ramp waveform applied to the scan electrodes is varied depending on a driving temperature or an ambient temperature of a PDP, or an amount of gray levels to be represented in a reset period of a $n^{th}$ (n is an integer greater than 2) subfield of the remaining subfields other than a first subfield of each frame. Therefore, a PDP can be driven stably without respect to driving conditions of the PDP. Lastly, in the present invention, after a sustain discharge is completed, an on-cell control pulse is applied to the scan electrodes and an off-cell control ramp waveform having a different peak voltage depending on driving conditions of a PDP is applied to the scan electrodes in a reset period of a $n^{th}$ (n is an integer greater than 2) subfield of the remaining subfields other than a first subfield of each frame. Therefore, a high contrast image can be stably represented regardless of driving conditions of a PDP.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Preferred embodiments of the present invention will be described in a more detailed manner with reference to the drawings.

Preferred embodiments of the present invention will be described with reference to FIGS. 4 to 23.

Figure 1:
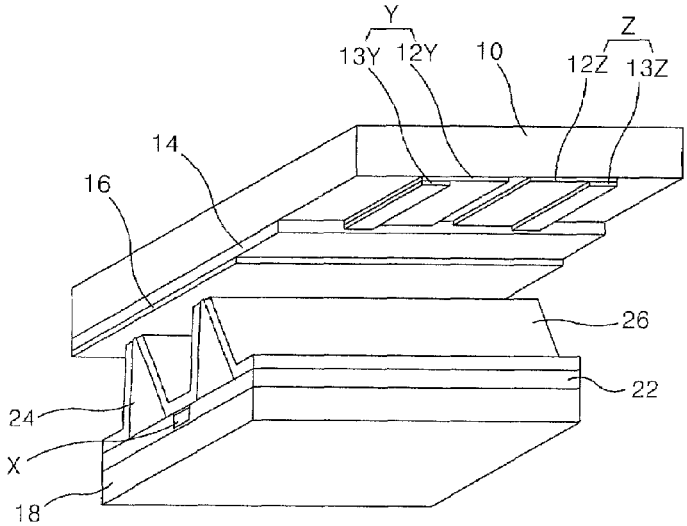
FIG. 1 PRIOR ART
FIG. 1 is a perspective view illustrating the structure of a discharge cell of a three-electrode AC surface discharge type PDP in the related art.
Figure 2:
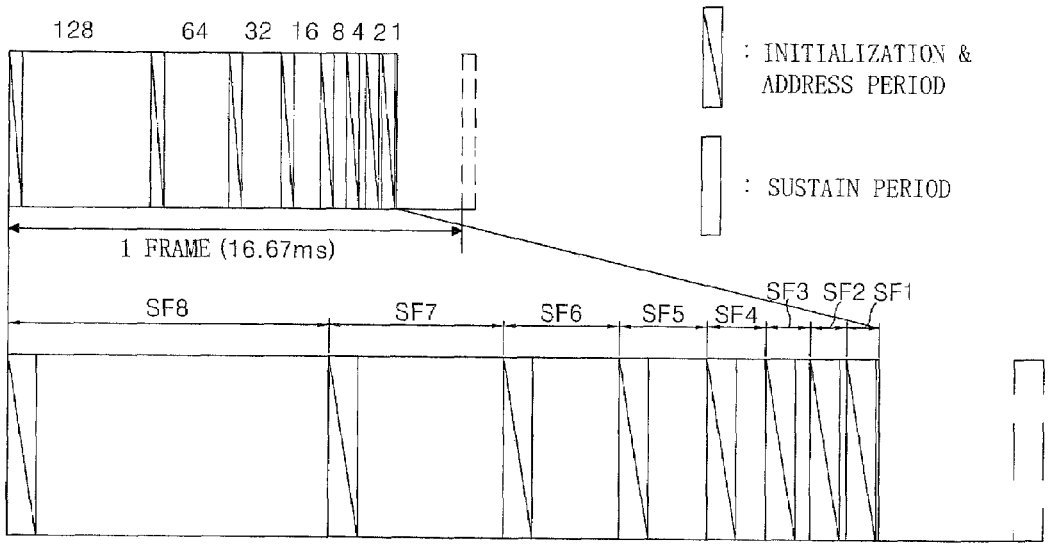
FIG. 2 PRIOR ART
FIG. 2 is a view showing an example of one frame luminance weight.
Figure 3:
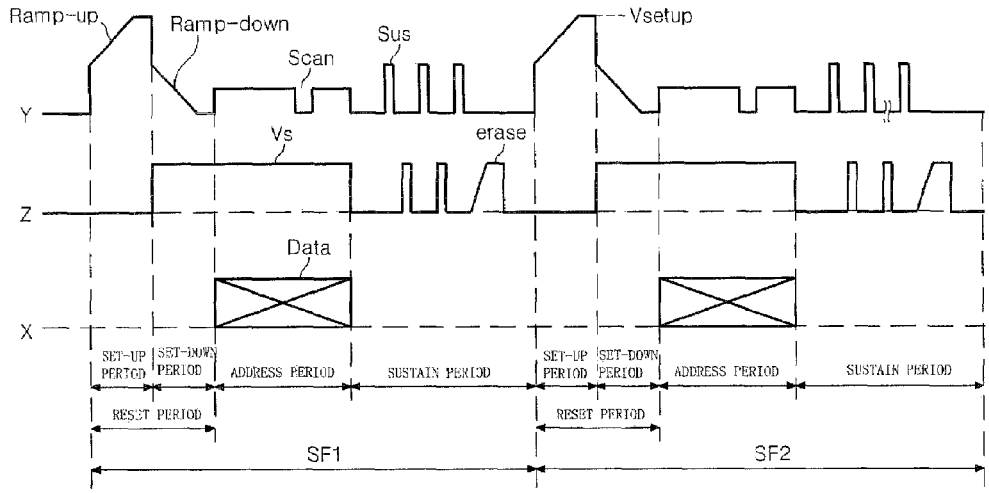
FIG. 3 PRIOR ART
FIG. 3 shows a waveform for illustrating a method of driving a PDP in the related art.
Figure 4:
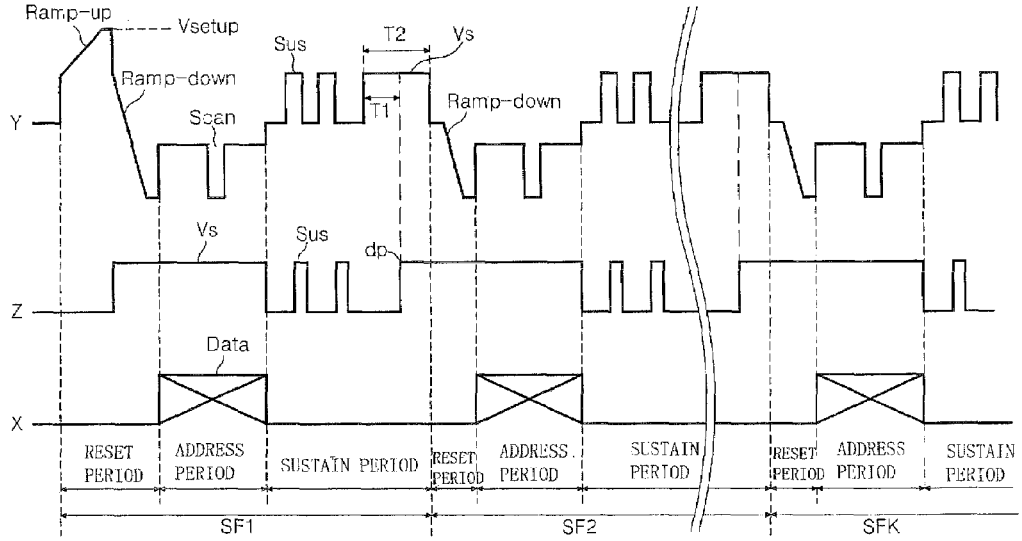
FIG. 4 shows a waveform for illustrating a method of driving a PDP according to a first embodiment of the present invention.

FIG. 4 shows a waveform for illustrating a method of driving a PDP according to a first embodiment of the present invention.

Referring to FIG. 4, in the method of driving the PDP according to a first embodiment of the present invention, the PDP is driven with one frame being divided into a number of subfields. Each of the sub fields is driven with it being divided into a reset period for initializing cells of the entire screen, an address period for selecting a cell, and a sustain period for sustaining the discharge of a selected cell.

In one frame, a ramp-up waveform (Ramp-up), which rises to a set-up voltage (Vsetup), is applied to scan electrodes Y at the same time during a set-up period of the reset period of a first subfield. The ramp-up waveform (Ramp-up) generates a weak discharge (a set-up discharge) within the cells of the entire screen, so that wall charges are generated within the cells. The ramp-up waveform (Ramp-up) is applied to only the first subfield (SF1) of one frame. After the ramp-up waveform (Ramp-up) is applied, a ramp-down waveform (Ramp-down), which falls from a sustain voltage (Vs) lower than a peak voltage of the ramp-up waveform (Ramp-up), is applied to the scan electrodes Y at the same time during a set-down period of the reset period. The ramp-down waveform (Ramp-down) generates a weak erase discharge within the cells, thus erasing unnecessary charges, such as wall charges generated by the set-up discharge and spatial discharges, and causing wall charges necessary for an address discharge to uniformly remain within the cells.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within cells to which the data pulse (Data) has been applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the scan electrodes Y to when the address period is ended.

In the sustain period, a sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

After the sustain pulse (Sus) is applied during the sustain period, the sustain voltage (Vs) is applied to the scan electrodes Y for a predetermined time (T2). Furthermore, an on-cell control pulse (dp), which is a predetermined time (T3) later than the sustain voltage (Vs) applied to the scan electrodes Y, is applied to the sustain electrodes Z. A voltage value of the on-cell control pulse (dp) is set to have the same value as that of the sustain voltage (Vs).

If the sustain voltage (Vs) is applied to the scan electrodes Y, a last sustain discharge is generated in the discharge cells. This will be described in detail below. The on-cell control pulse (dp) applied to the sustain electrodes Z is a predetermined time (T1) later than the sustain voltage (Vs) applied to the scan electrodes Y. Therefore, since a voltage difference of the sustain voltage (Vs) is generated in the discharge cells during the predetermined time (T1), a sustain discharge is generated in the discharge cells. Practically, the predetermined time (T1) is set to a time where the sustain discharge can be generated stably in the discharge cells.

After the last sustain discharge is generated in the discharge cells, the on-cell control pulse (dp) is applied to the sustain electrodes Z. The on-cell control pulse (dp) erases a desired amount of wall charges of discharge cells in which the sustain discharge has been generated. Due to this, the wall voltage of the discharge cells in which the sustain discharge has been generated moves to a desired location. This will be described in detail later on.

Thereafter, during a reset period of the second subfield, the ramp-down waveform (Ramp-down) that falls to the sustain voltage (Vs) is applied to the scan electrodes Y at the same time. The amount of wall charges generated can be controlled by adjusting the degree of a discharge through the control of the amount of a voltage of the ramp-down waveform (Ramp-down). If the ramp-down waveform (Ramp-down) is applied to the scan electrodes Y, an erase discharge is generated in on-cells in which the sustain discharge has been generated during the sustain period of the first subfield. Due to this, a wall voltage of discharge cells of on-cells, which have moved to a predetermined location, is converged to a desired location. The erase discharge causes wall charges necessary for an address discharge to uniformly remain.

Meanwhile, off-cells in which the sustain discharge has not been generated in the first subfield maintain wall charges formed in the reset period of the first subfield. Therefore, the off-cells do not generate the erase discharge when the ramp-down waveform (Ramp-down) of the second subfield is supplied.

In the address period of the second subfield, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and the wall voltage generated in the reset period are added, an address discharge is generated within cells to which the data pulse (Data) has applied. Predetermined wall charges are generated within cells selected by the address discharge.

Meanwhile, a last sustain pulse (sus1) is applied to the scan electrodes Y. A positive (+) sustain voltage (Vs) is applied to the sustain electrodes Z until a time point where the address period is ended after a predetermined time (T3) elapses.

In the sustain period, the sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

Practically, in the method of driving the PDP according to a first embodiment of the present invention, a predetermined image is displayed while repeating the above process. That is, in the method of driving the PDP according to a first embodiment of the present invention, the ramp-up waveform (Ramp-down) having a set-up voltage (Vsetup) is applied only in the reset period of the first subfield of one frame. Therefore, light is generated only in the first subfield by the set-up discharge and light is not generated in the remaining subfields by the set-up discharge. It is thus possible to improve contrast and reduce power consumption.

Figure 5:
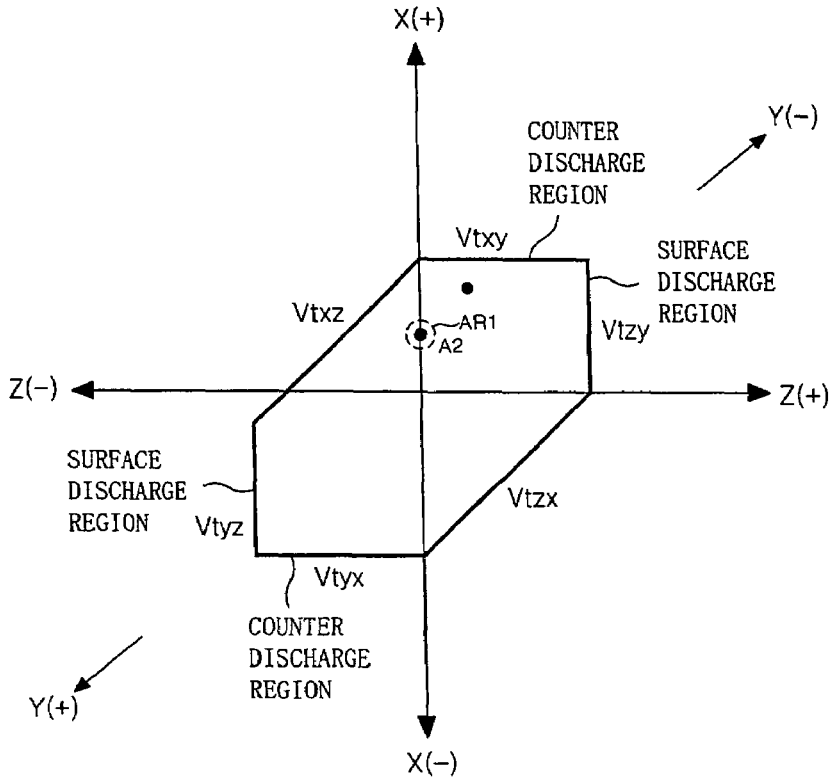
FIG. 5 is a view showing a wall voltage location of an on-cell and an off-cell within a voltage curve when a sustain discharge is normally generated.

The operating principle of the on-cell control pulse (dp) will be described in detail using a voltage curve (a Vt closed curve) of a hexagonal shape as shown in FIG. 5. The voltage curve is employed as the discharge generation principle of a PDP and a method of measuring voltage margin.

In FIG. 5, the hexagonal region within the voltage curve is an area where the cell voltage within the discharge cell is moved. When the cell voltage is located in the internal hexagonal region, a discharge is not generated in this region. (i.e., when the cell voltage is located in the hexagonal external region, a discharge is generated.) In other words, the inside of the voltage curve is a non-discharge region where a discharge is not generated within the discharge cell. The outside of the voltage curve is a discharge region where a discharge is generated within the discharge cell. "Y(−)" indicates a direction where the cell voltage is moved when a negative (−) voltage is applied to the scan electrodes Y. In a similar way, each of "Y(+), X(+), X(−), Z(+) and Z(−)" indicates a direction where the cell voltage is moved when a negative (−) or positive (+) is applied to the scan electrodes Y, the address electrodes X and the sustain electrodes Z.

Furthermore, "Vtxy" in a counter discharge region of a quadrant 1 of the voltage curve graph indicates a voltage in which a discharge begins between the address electrodes X and the scan electrodes Y when the voltage is applied to the address electrodes X. Therefore, the straight line indicating the quadrant 1 counter discharge region of the voltage curve graph is decided as a length as much as a voltage in which a discharge begins between the address electrodes X and the scan electrodes Y. In addition, "Vtzy" in a counter discharge region of a quadrant 1 of the voltage curve graph indicates a voltage in which a discharge begins the sustain electrodes Z and the scan electrodes Y when the voltage is applied to the sustain electrodes Z. In a similar way, each of "Vtxz, Vtzx, Vtyz and Vtyx" indicates a discharge firing voltage between the electrodes. Meanwhile, voltages of Vtxy, Vtzy, Vtxz, Vtzx, Vtyz, Vtyx, etc. are varied a little depending on a panel. The shape of a voltage curve is also varied a little depending on (a cell size, process deviation, etc.).

Assuming that the on-cell control pulse (dp) is not applied, an operation will be first described. After the sustain pulse (Sus) is applied, the sustain voltage (Vs) is applied to the scan electrodes Y during a predetermined time (T2). A wall voltage of on-cells is located at a point A1 of the quadrant 1 of the voltage curve by a sustain discharge generated by the sustain voltage (Vs), as shown in FIG. 5. In addition, a wall voltage of off-cells (i.e., cells where the address discharge has not been generated in a previous subfield), in which the sustain discharge has not been generated in the sustain period, is located at a point A2 of the X(+) axis (Practically, the wall voltage of the off-cells is located at a predetermined region (AR1) including the point A2). The X(+) axis indicates a point where the wall voltage of the discharge cells is located when the discharge cells are initialized at normal temperature (approximately, a temperature from more than 10° C. to less than 40° C.).

Figure 6:
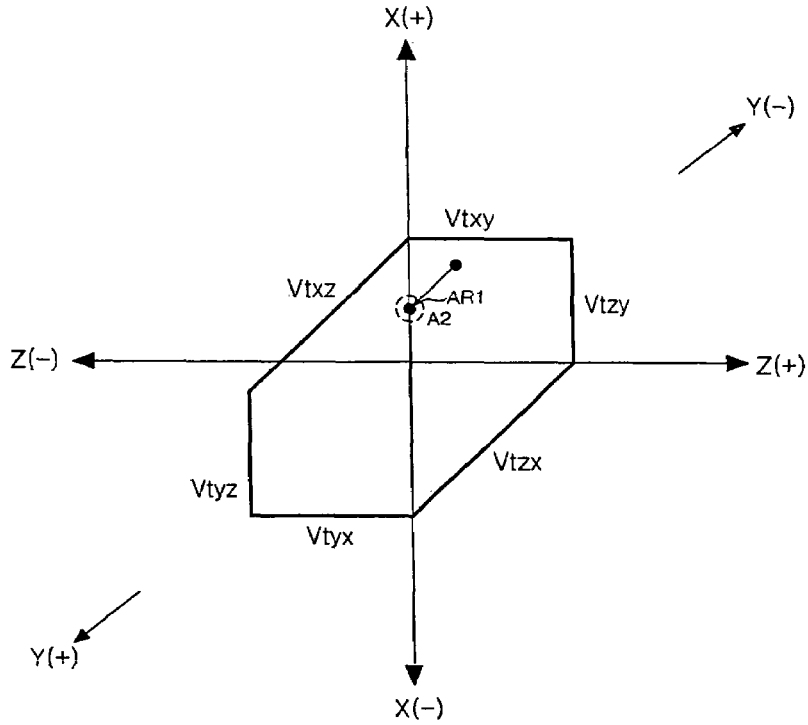
FIG. 6 is a view showing that a wall voltage of on-cells is moved when the ramp-down waveform shown in FIG. 4 is applied.

Thereafter, during the reset period of a next subfield, the ramp-down waveform (Ramp-down) is applied to the scan electrodes Y. At this time, since the cell voltage of the on-cells is moved toward the Y(−) side, the wall voltage of the on-cells is moved from the point A1 to the point A2, as shown in FIG. 6. That is, the wall voltage of the entire discharge cells is moved to the point A2 by means of the ramp-down waveform (Ramp-down), so that the discharge cells are initialized. The location of the point A2 is set to a location where the address discharge is generated when the negative (−) scan pulse (Scan) and the positive (+) data pulse (Data) are supplied to a subsequent address period. Thereafter, a PDP displays a predetermined image after experiencing the address period and the sustain period.

Figure 7:
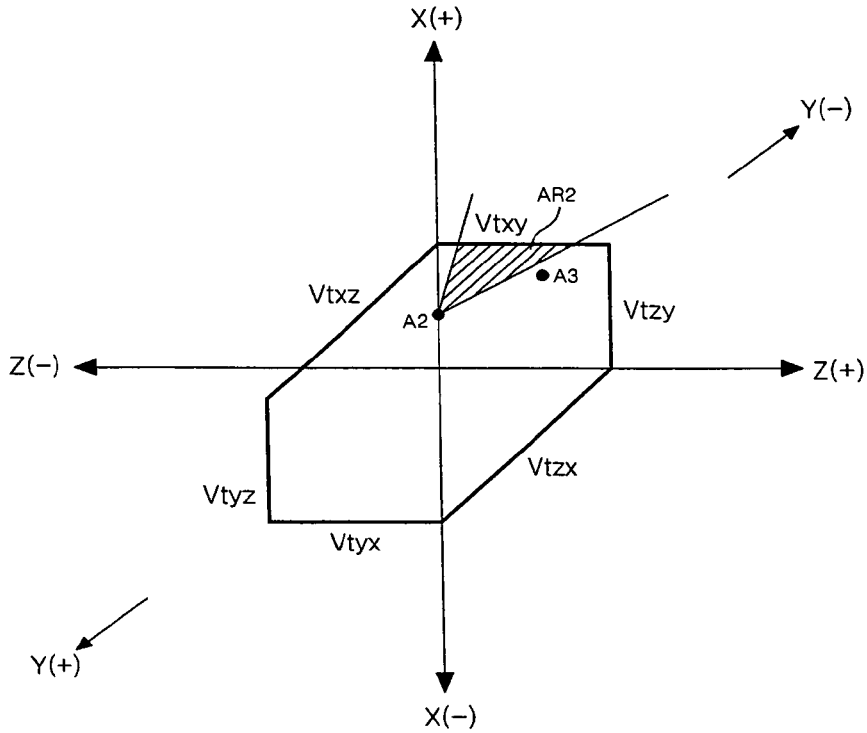
FIG. 7 is a view showing that a wall voltage of on-cells is located at an unwanted location due to a particular cause.

However, if the on-cell control pulse (dp) is not applied in the reset period when an unstable discharge is generated in a discharge cell due to a driving temperature or an ambient temperature of a PDP (e.g., high temperature or low temperature) or an amount of gray levels to be represented (i.e., external environment), there is a case where a wall voltage of the on-cells is located at a point A3 outside a convergence area (AR2) when the sustain discharge is completed, as shown in FIG. 7. In this case, the off-cell convergence area (AR2) is an area in which the wall voltage of the on-cells can be converged to the location of the point A2 when the ramp-down waveform (Ramp-down) is applied. Therefore, if the wall voltage of the on-cells is located outside the off-cell convergence area (AR2), the wall voltage of the on-cells is not located at a desired location due to the ramp-down waveform (Ramp-down). This leads to generation of an erroneous discharge.

Figure 8:
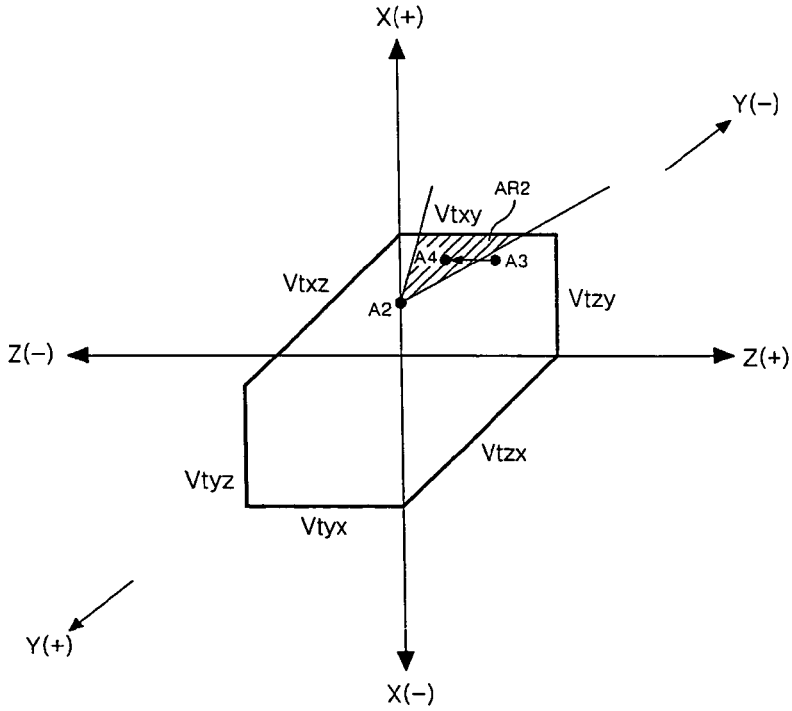
FIG. 8 is a view showing that a wall voltage of on-cells is moved when a on-cell control pulse shown in FIG. 4 is applied.

To prevent the above problem, in the method of driving the PDP according to a second embodiment of the present invention, after a predetermined time (T1) elapses since the sustain voltage (Vs) is applied to the scan electrodes Y, the on-cell control pulse (dp) is applied to the sustain electrodes Z. Due to this, as the cell voltage of the on-cells is moved toward the Z(+) side, the wall voltage of the on-cells is moved from the point A3 to a point A4 of the off-cell convergence area (AR2), as shown in FIG. 8.

Figure 9:
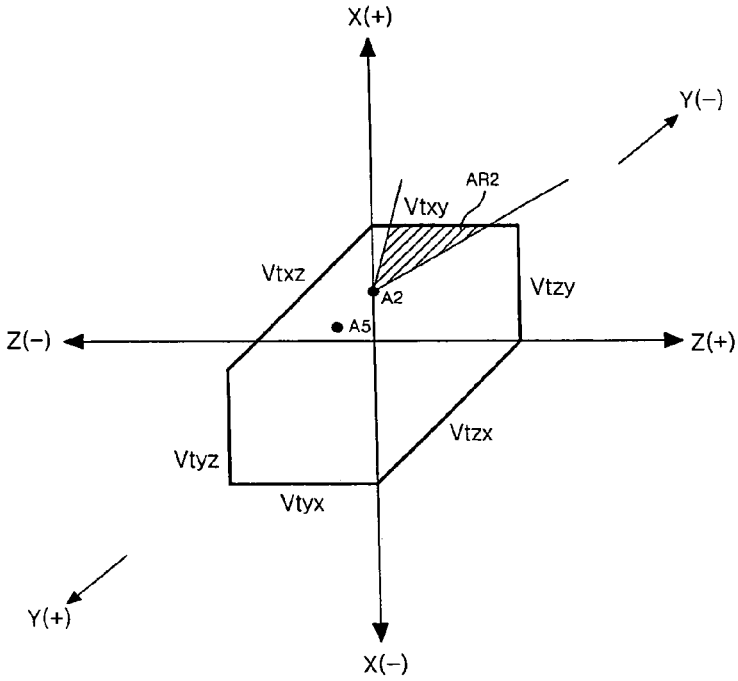
FIG. 9 is a view showing that a wall voltage of off-cells is located at an unwanted location due to a particular cause.

Meanwhile, since the wall voltage of the off-cells has not generated the sustain discharge, it has to maintain the location of the point A2. However, there is a case where the wall voltage of the off-cells is deviated from the point A2 and is then located at a point A5 adjacent to the Z(−) axis of the voltage curve depending on a driving temperature or an ambient temperature of a PDP (e.g., high temperature or low temperature) or an amount of gray levels to be represent, as shown in FIG. 9. This will be described in more detail below. When a driving temperature or an ambient temperature of a PDP is high temperature (approximately 40° C. or higher), a sustain discharge is further activated in subfields responsible for high gray level representation compared to normal temperature (approximately from more than 10° C. to less than 40° C.) during the sustain period. Therefore, priming is generated. Due to this, an initialization condition in subfields responsible for high gray level representation when a driving temperature or an ambient temperature of a PDP is high temperature is different from that in normal temperature. For this reason, the wall voltage of the off-cells is deviated from the point A2 and is then located at the point A5 adjacent to the Z(−) axis of the voltage curve, as shown in FIG. 9. At this time, as a driving temperature or an ambient temperature of a PDP becomes high, the wall voltage of the off-cells location becomes adjacent to the Z(−) axis under the influence of a peripheral discharge. If the wall voltage of the off-cells is located at the point A5 as described above, the wall voltage of the off-cells is not converged at a desired location due to the ramp-down waveform (Ramp-down). Since initialization is not smoothly generated during the reset period, an address discharge is not generated. A cell erase phenomenon is generated in a high gray level representation subfield. Therefore, a problem arises because an erroneous discharge is generated.

Figure 10:
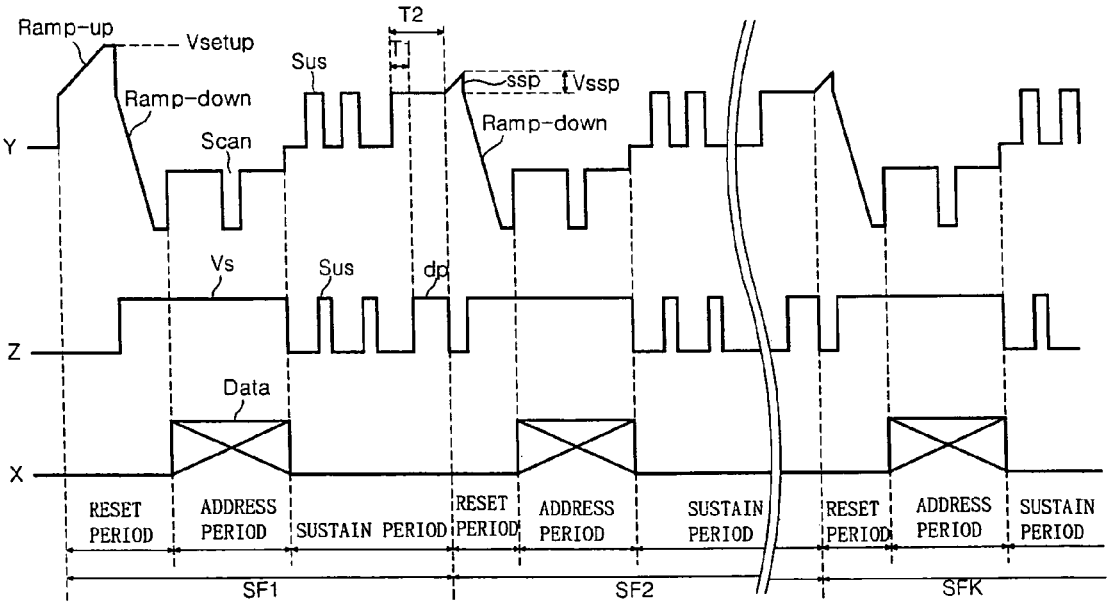
FIG. 10 shows a waveform for illustrating a method of driving a PDP according to a second embodiment of the present invention.

FIG. 10 shows a waveform for illustrating a method of driving a PDP according to a second embodiment of the present invention.

Referring to FIG. 10, in the method of driving the PDP according to a second embodiment of the present invention, the PDP is driven with one frame being divided into a number of subfields. Each of the sub fields is driven with it being divided into a reset period for initializing cells of the entire screen, an address period for selecting a cell, and a sustain period for sustaining the discharge of a selected cell.

In one frame, during a set-up period of the reset period of a first subfield, a ramp-up waveform (Ramp-up), which rises to a set-up voltage (Vsetup), is applied to scan electrodes Y at the same time. The ramp-up waveform (Ramp-up) generates a weak discharge (a set-up discharge) within the cells of the entire screen, so that wall charges are generated within the cells. The ramp-up waveform (Ramp-up) is applied to only the first subfield (SF1) of one frame. After the ramp-up waveform (Ramp-up) is applied, during a set-down period of the reset period, a ramp-down waveform (Ramp-down), which falls from a sustain voltage (Vs) lower than a peak voltage of the ramp-up waveform (Ramp-up), is applied to the scan electrodes Y at the same time. The ramp-down waveform (Ramp-down) generates a weak erase discharge within the cells, thus erasing unnecessary charges, such as wall charges generated by the set-up discharge and spatial discharges, and also causing wall charges necessary for an address discharge to uniformly remain within the cells.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within cells to which the data pulse (Data) has been applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the scan electrodes Y to when the address period is ended.

In the sustain period, a sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

After the sustain pulse (Sus) is applied during the sustain period, the sustain voltage (Vs) is applied to the scan electrodes Y for a predetermined time (T2). Furthermore, an on-cell control pulse (dp), which is a predetermined time (T3) later than the sustain voltage (Vs) applied to the scan electrodes Y, is applied to the sustain electrodes Z. A voltage value of the on-cell control pulse (dp) is set to have approximately the same value as that of the sustain voltage (Vs).

If the sustain voltage (Vs) is applied to the scan electrodes Y, a last sustain discharge is generated in the discharge cells. This will be described in detail below. The on-cell control pulse (dp) applied to the sustain electrodes Z is the predetermined time (T1) later than the sustain voltage (Vs) applied to the scan electrodes Y. Therefore, since a voltage difference of the sustain voltage (Vs) is generated in the discharge cells during the predetermined time (T1), a sustain discharge is generated in the discharge cells. Practically, the predetermined time (T1) can be set to a time where the sustain discharge can be generated stably in the discharge cells.

After the last sustain discharge is generated in the discharge cells, the on-cell control pulse (dp) is applied to the sustain electrodes Z. The on-cell control pulse (dp) erases a desired amount of wall charges of discharge cells in which the sustain discharge has been generated. Due to this, the wall voltage of the discharge cells in which the sustain discharge has been generated moves to a desired location. This will be described in detail later on.

After the sustain voltage (Vs) is applied during the predetermined time (T2), an off-cell control ramp waveform (ssp) (i.e., a sub rising waveform) is applied to the scan electrodes Y during a set-up period of the reset period of a second subfield. The off-cell control ramp waveform (ssp) is set to a ramp waveform that gradually rises from the sustain voltage (Vs). The wall voltage of the off-cells moves to a desired location by the off-cell control ramp waveform (ssp). This will be described in detail below. Meanwhile, a voltage value (Vssp) of the off-cell control ramp waveform (ssp) is set to 20V or higher (Vs+20V) and is also set lower than the set-up voltage (Vsetup). In addition, the time of the predetermined time (T2) can be set to a time where a wall voltage of discharge cells of on-cells in which a sustain discharge has been generated can be stably converged to a desired location, e.g., 7 μs or higher. While the off-cell control ramp waveform (ssp) is applied to the scan electrodes Y, a ground voltage (GND) is applied to the sustain electrodes Z so that the wall voltage of the off-cells can be stably located at a desired location.

After the off-cell control ramp waveform (ssp) (i.e., the sub rising waveform) is applied to the scan electrodes Y, a ramp-down waveform (Ramp-down), which falls from the sustain voltage (Vs), is applied to the entire scan electrodes Y during the set-down period of the reset period. If the ramp-down waveform (Ramp-down) is applied, the wall voltage of the discharge cells, which has been moved to a desired location, is converted to a desired location by means of the off-cell control ramp waveform (ssp) and the on-cell control pulse (dp). That is, a weak discharge, which is generated by the ramp-down waveform (Ramp-down), causes wall charges necessary for an address discharge to remain.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and the wall voltage generated in the reset period are added, an address discharge is generated in cells to which the data pulse (Data) has applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the address electrodes X to when the address period is ended.

In the sustain period, the sustain pulse (Sus) is alternately applied to the scan electrodes Y and the sustain electrodes Z.

A sustain discharge is generated in surface discharge form between the scan electrodes Y and the sustain electrodes Z in cells selected by the address discharge whenever the sustain pulse (Sus) is applied as the wall voltage within the cells and the sustain pulse (Sus) are added. The number of the sustain pulse (Sus) applied during the sustain period can be set corresponding to a luminance weight of each frame.

Practically, in the method of driving the PDP according to a second embodiment of the present invention, a predetermined image is displayed while repeating the above process. That is, in the method of driving the PDP according to a second embodiment of the present invention, the ramp-up waveform (Ramp-down) having a set-up voltage (Vsetup) is applied only in the reset period of the first subfield of one frame. Therefore, high contrast can be secured.

The operating principle of the off-cell control ramp waveform (ssp) (i.e., the sub rising waveform) and the on-cell control pulse (dp) having a sustain voltage value will be describe in detail using the voltage curve (Vt close curve) of a hexagonal shape as shown in FIG. 5. The voltage curve is employed as the discharge generation principle of a PDP and a method of measuring voltage margin.

In FIG. 5, the hexagonal region within the voltage curve is an area where the cell voltage within the discharge cell is moved. When the cell voltage is located in the internal hexagonal region, a discharge is not generated in this region. (i.e., when the cell voltage is located in the hexagonal external region, a discharge is generated.) In other words, the inside of the voltage curve is a non-discharge region where a discharge is not generated in the discharge cell. The outside of the voltage curve is a discharge region where a discharge is generated in the discharge cell. "Y(−)" indicates a direction where the cell voltage is moved when a negative (−) voltage is applied to the scan electrodes Y. In the same manner, each of "Y(+), X(+), X(−), Z(+) and Z(−)" indicates a direction where the cell voltage is moved when a negative (−) or positive (+) is applied to the scan electrodes Y, the address electrodes X and the sustain electrodes Z.

Furthermore, "Vtxy" in a quadrant 1 counter discharge region of the voltage curve graph indicates a voltage in which a discharge begins between the address electrodes X and the scan electrodes Y when the voltage is applied to the address electrodes X. Therefore, a straight line indicating the quadrant 1 counter discharge region of the voltage curve graph is decided as a length as much as a voltage in which a discharge begins between the address electrodes X and the scan electrodes Y. In addition, "Vtzy" in the quadrant 1 surface discharge region of the voltage curve graph indicates a voltage in which a discharge begins the sustain electrodes Z and the scan electrodes Y when the voltage is applied to the sustain electrodes Z. In the same manner, each of "Vtxz, Vtzx, Vtyz and Vtyx" indicates a discharge firing voltage between electrodes. Meanwhile, voltages of Vtxy, Vtzy, Vtxz, Vtzx, Vtyz, Vtyx, etc. are varied a little depending on a panel. The shape of a voltage curve is also varied a little depending on (a cell size, process deviation, etc.).

Assuming that the off-cell control ramp waveform (ssp) and the on-cell control pulse (dp) are not applied, an operation will be first described. After the sustain pulse (Sus) is applied, the sustain voltage (Vs) is applied to the scan electrodes Y during a predetermined time (T2). A wall voltage of on-cells is located at a point A1 of the quadrant 1 of the voltage curve by a sustain discharge generated by the sustain voltage (Vs), as shown in FIG. 5. In addition, a wall voltage of off-cells (i.e., cells in which an address discharge has not been generated in a previous subfield), in which a sustain discharge has not been generated in the sustain period, is located at a point A2 of the X(+) axis (Practically, the wall voltage of the off-cells is located at a predetermined region (AR1) including the point A2). The X(+) axis indicates a point where a wall voltage of the discharge cells is located at normal temperature.

Thereafter, during a reset period of a next subfield, the ramp-down waveform (Ramp-down) is applied to the scan electrodes Y. At this time, since the cell voltage of the on-cells is moved toward the Y(−) side, the wall voltage of the on-cells is moved from the point A1 to the point A2, as shown in FIG. 6. That is, the wall voltage of the entire discharge cells is moved to the point A2 by the ramp-down waveform (Ramp-down), so that the discharge cells are initialized. The location of the point A2 is set to a location in which an address discharge is generated when the negative (−) scan pulse (Scan) and the positive (+) data pulse (Data) are supplied to a subsequent address period. Thereafter, a PDP displays a predetermined image after experiencing the address period and the sustain period.

However, if the on-cell control pulse (dp) is not applied in the reset period when an unstable discharge is generated in a discharge cell due to a driving temperature or an ambient temperature of a PDP (e.g., high temperature or low temperature) or an amount of gray levels to be represented (i.e., external environment), there is a case where a wall voltage of the on-cells is located at a point A3 outside a convergence area (AR2) when the sustain discharge is completed, as shown in FIG. 7. In this case, the off-cell convergence area (AR2) is an area in which the wall voltage of the on-cells can be converged to the location of the point A2 when the ramp-down waveform (Ramp-down) is applied. Therefore, if the wall voltage of the on-cells is located outside the off-cell convergence area (AR2), the wall voltage of the on-cells is not located at a desired location due to the ramp-down waveform (Ramp-down). This leads to generation of an erroneous discharge.

To prevent this, in the method of driving the PDP according to a second embodiment of the present invention, after a predetermined time (T1) elapses since the sustain voltage (Vs) is applied to the scan electrodes Y, the on-cell control pulse (dp) is applied to the sustain electrodes Z. Due to this, as the cell voltage of the on-cells is moved toward the Z(+) side, the wall voltage of the on-cells is moved from the point A3 to a point A4 of the off-cell convergence area (AR2), as shown in FIG. 8. Therefore, the PDP can be driven stably. The voltage value of the on-cell control pulse (dp) is set to approximately the sustain voltage (Vs) so that a wall voltage of on-cells located in a region outside the off-cell convergence area (AR2) can be moved to the off-cell convergence area (AR2).

Meanwhile, since the wall voltage of the off-cells has not generated the sustain discharge, it has to maintain the location of the point A2. However, there is a case where the wall voltage of the off-cells is deviated from the point A2 and is then located at a point A5 adjacent to the Z(−) axis of the voltage curve according to a driving temperature or an ambient temperature of a PDP (e.g., high temperature or low temperature) or an amount of gray levels to be represent, as shown in FIG. 9. At this time, the high temperature is approximately 40° C. or higher and the low temperature is less than approximately 10° C. If the wall voltage of the off-cells is located at the point A5 as described above, the wall voltage of the off-cells may not be converged to a desired location due to the ramp-down waveform (Ramp-down). Therefore, a problem arises because an erroneous discharge is generated in a PDP.

Figure 11:
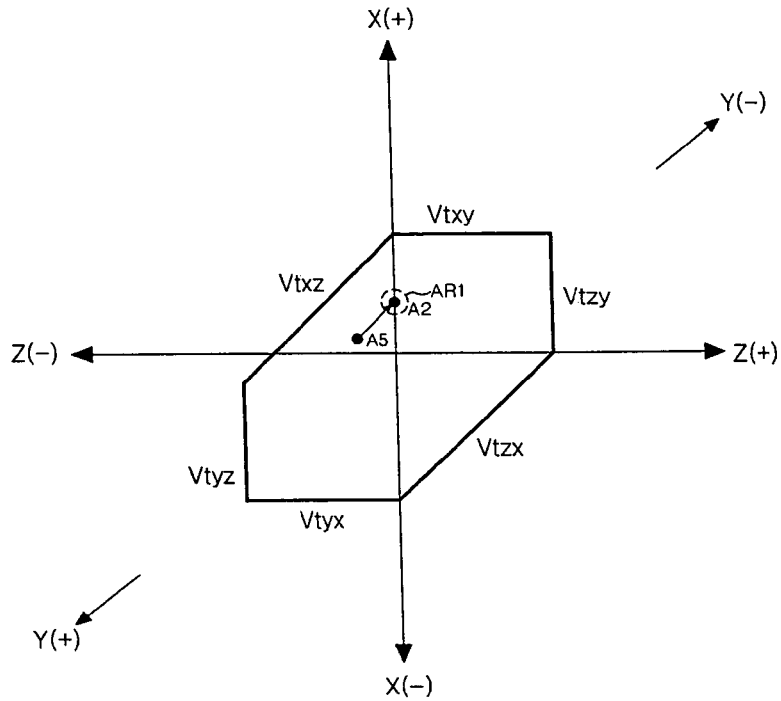
FIG. 11 is a view showing that a wall voltage of off-cells is moved when an off-cell control ramp waveform shown in FIG. 10 is applied.

To prevent this, in the method of driving the PDP according to a second embodiment of the present invention, after the sustain voltage (Vs) is applied to the scan electrodes Y, the off-cell control ramp waveform (ssp) that rises from the sustain voltage (Vs) with a slope is applied. Due to this, as the cell voltage of the off-cells is moved toward the Y(+) side, the wall voltage of the off-cells is moved from the point A5 to the point A2, as shown in FIG. 11. Therefore, during the reset period, the discharge cells are initialized.

Figure 12:
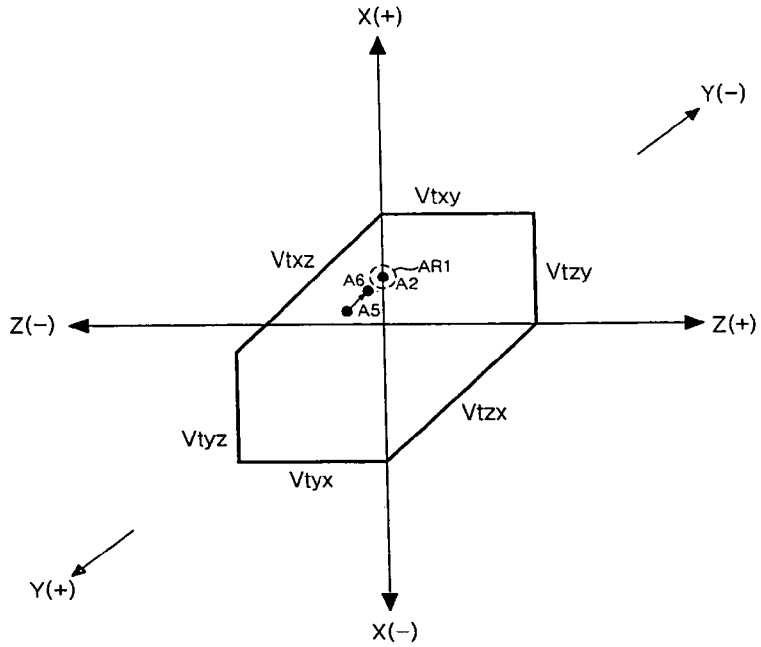
FIGS. 12 and 13 are views showing that a wall voltage of off-cells is located at an unwanted location due to a particular cause when an off-cell control ramp waveform shown in FIG. 10 is applied.
Figure 13:
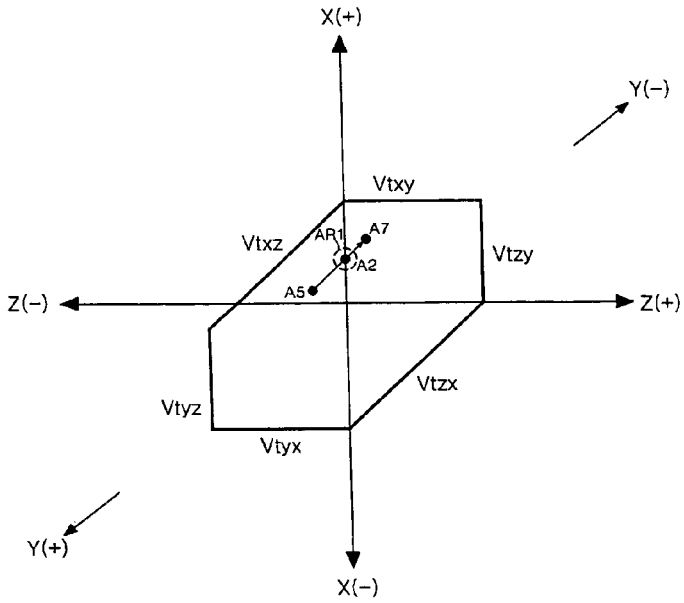

In the method of driving the PDP according to a second embodiment of the present invention, however, the off-cell control ramp waveform (ssp) of the same amount is applied to the scan electrodes Y regardless of a driving temperature or an ambient temperature (e.g., high temperature or low temperature) of a PDP or an amount of gray levels to be represented. Therefore, in the case where a driving temperature or an ambient temperature of a PDP is changed when representing high gray levels, a wall voltage of off-cells may be located at a point A6, which does not reach the predetermined region (AR1) of the point A2 as shown in FIG. 12, or may be located at a point A7, which is deviated from the predetermined region (AR1) of the point A2 as shown in FIG. 13. Due to this, since initialization is not normally performed in the discharge cell during the reset period, an address discharge is not normally generated, which is results in an erroneous discharge. However, this problem can be solved by changing the amount of the off-cell control ramp waveform (ssp) according to a driving temperature or an ambient temperature of a PDP (e.g., high temperature or low temperature) or an amount of gray levels to be represented, as shown in FIG. 14.

Figure 14:
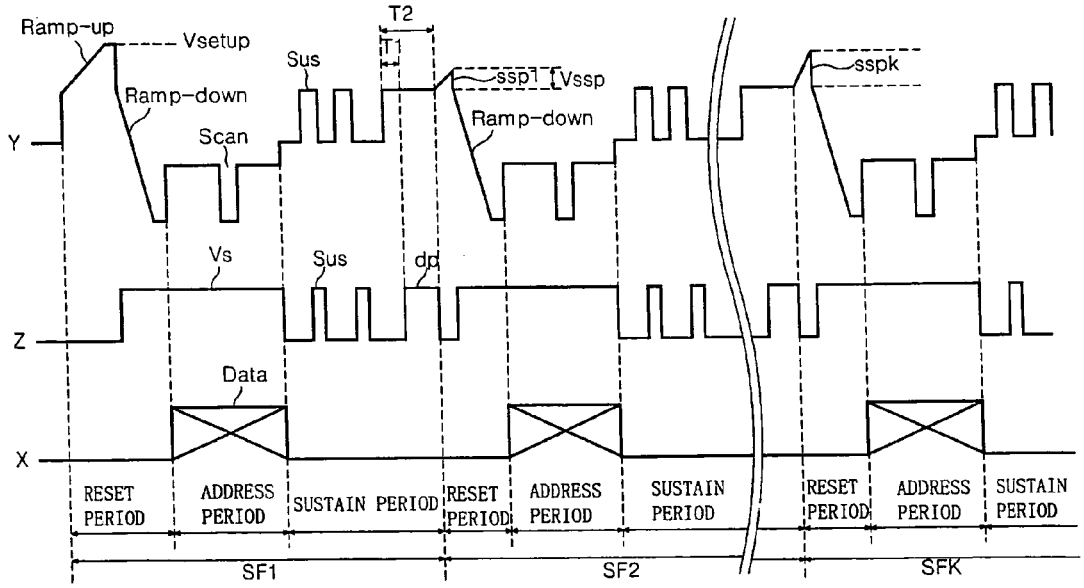
FIG. 14 shows a waveform for illustrating a method of driving a PDP according to a third embodiment of the present invention.

FIG. 14 shows a waveform for illustrating a method of driving a PDP according to a third embodiment of the present invention.

Referring to FIG. 14, in the method of driving the PDP according to a third embodiment of the present invention, the PDP is driven with one frame being divided into a number of subfields. Each of the sub fields is driven with it being divided into a reset period for initializing cells of the entire screen, an address period for selecting a cell, and a sustain period for sustaining the discharge of a selected cell.

In one frame, during a set-up period of the reset period of a first subfield, a ramp-up waveform (Ramp-up), which rises to a set-up voltage (Vsetup), is applied to scan electrodes Y at the same time. The ramp-up waveform (Ramp-up) generates a weak discharge (a set-up discharge) within the cells of the entire screen, so that wall charges are generated within the cells. The ramp-up waveform (Ramp-up) is applied to only the first subfield (SF1) of one frame. After the ramp-up waveform (Ramp-up) is applied, during a set-down period of the reset period, a ramp-down waveform (Ramp-down), which falls from a sustain voltage (Vs) lower than a peak voltage of the ramp-up waveform (Ramp-up), is applied to the scan electrodes Y at the same time. The ramp-down waveform (Ramp-down) generates a weak erase discharge within the cells, thus erasing unnecessary charges, such as wall charges generated by the set-up discharge and spatial discharges, and also causing wall charges necessary for an address discharge to uniformly remain within the cells.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within cells to which the data pulse (Data) has been applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the scan electrodes Y to when the address period is ended.

In the sustain period, a sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

After the sustain pulse (Sus) is applied during the sustain period, the sustain voltage (Vs) is applied to the scan electrodes Y for a predetermined time (T2). Furthermore, an on-cell control pulse (dp), which rises at a predetermined time (T3) later than the sustain voltage (Vs) applied to the scan electrodes Y, is applied to the sustain electrodes Z. A voltage value of the on-cell control pulse (dp) is set to have approximately the same value as that of the sustain voltage (Vs).

If the sustain voltage (Vs) is applied to the scan electrodes Y, a last sustain discharge is generated in the discharge cells. This will be described in detail below. The on-cell control pulse (dp) applied to the sustain electrodes Z is the predetermined time (T1) later than the sustain voltage (Vs) applied to the scan electrodes Y. Therefore, since a voltage difference of the sustain voltage (Vs) is generated in the discharge cells during the predetermined time (T1), a sustain discharge is generated in the discharge cells. At this time, the predetermined time (T1) can be set to a time in which the amount of wall charges within discharge cells can be controlled. In addition, the predetermined time (T1) can be set to a time where a sustain discharge can be generated stably in discharge cells.

After the last sustain discharge is generated in the discharge cells, the on-cell control pulse (dp) is applied to the sustain electrodes Z. The on-cell control pulse (dp) erases a desired amount of wall charges of discharge cells in which the sustain discharge has been generated. Due to this, the wall voltage of the discharge cells in which the sustain discharge has been generated moves to a desired location. This will be described in detail later on.

After the sustain voltage (Vs) is applied during the predetermined time (T2), an off-cell control ramp waveform (ssp) is applied to the scan electrodes Y in a reset period of an $n^{th}$ (n is an integer greater than 2) subfield of the remaining subfields other than the first subfield of one frame. In this case, a positive (+) sustain voltage (Vs) is applied to the scan electrodes Y in a reset period of a subfield in which the off-cell control ramp waveform (ssp) has not been applied, of the remaining subfields other than the first subfield of one frame. At this time, the off-cell control ramp waveform (ssp) is set as a ramp waveform that gradually rises from the sustain voltage (Vs) and has a different voltage value depending on a driving temperature or an ambient temperature of a PDP or an amount of gray levels to be represented. In other words, variation in a characteristic of off-cells is different in subfields that represent high gray levels when a driving temperature or an ambient temperature of a PDP is changed. Therefore, the off-cell control ramp waveform (ssp) having a different peak voltage is applied to the scan electrodes Y in a reset period of an $n^{th}$ (n is an integer greater than 2) subfield of the remaining subfields other than the first subfield of one frame. The peak voltage of the off-cell control ramp waveform (ssp) is higher as subfields represent higher gray levels, but has the same slope regardless of a peak voltage value. In other words, a peak voltage of an off-cell control ramp waveform (sspk), which is applied to the scan electrodes Y in a reset period of a last subfield of one frame, is higher than that of a first off-cell control ramp waveform (ssp1), which is applied to the scan electrodes Y in a reset period of an $n^{th}$ (n is an integer greater than 2) subfield of the remaining subfields other than the first subfield of one frame. The peak voltage value of the off-cell control ramp waveform (ssp) can be controlled by adjusting a rising time of the off-cell control ramp waveform (ssp). Due to this, a wall voltage of the off-cells can be moved to a desired location without respect to a driving temperature or an ambient temperature of a PDP or an amount of gray levels to be represented. This will be described in detail later on. Meanwhile, a peak voltage value (Vssp) of the off-cell control ramp waveform (ssp) can be set to a range in which a wall voltage of off-cells can be moved to a desired location during a set-down period, e.g., from approximately 0V (Vs) to a set-up voltage (Vsetup). While the off-cell control ramp waveform (ssp) is applied to the scan electrodes Y, a ground voltage (GND) is applied to the sustain electrodes Z so that the wall voltage of the off-cells can be stably located at a desired location.

The address period and the sustain period of the remaining subfields other than the first subfield of one frame are the same as those of the method of driving the PDP according to a second embodiment of the present invention. Description thereof will be omitted.

Practically, in the method of driving the PDP according to a third embodiment of the present invention, a predetermined image is displayed while the above process is repeated. That is, in the method of driving the PDP according to a third embodiment of the present invention, the ramp-up waveform (Ramp-up) having the set-up voltage (Vstup) is supplied only during the reset period of the first subfield of one frame. Therefore, not only contrast can be improved, but also power consumption can be saved. Furthermore, in the method of driving the PDP according to a third embodiment of the present invention, a PDP is controlled so that it can be driven stably using the off-cell control ramp waveform (ssp) and the on-cell control pulse (dp) although the ramp-up waveform (Ramp-down) is not applied. In addition, in the driving method according to a third embodiment of the present invention, the off-cell control ramp waveform (ssp) having a different peak voltage is applied to the scan electrodes Y depending on a driving temperature or an ambient temperature of a PDP or an amount of gray levels to be represented in a reset period of an $n^{th}$ (n is an integer greater than 2) subfield of the remaining subfields other than a first subfield of one frame. Therefore, not only a PDP can be driven stably regardless of variation in ambient environment, but also a high contrast image ca be displayed.

Figure 15:
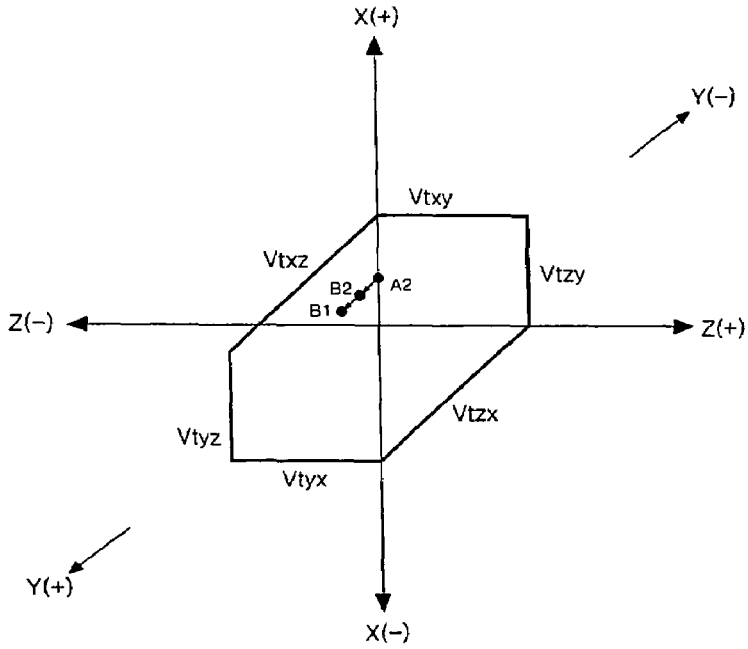
FIG. 15 is a view showing that a wall voltage of off-cells is moved due to a particular cause.

The operating principle of the off-cell control ramp waveform (ssp) will be describe in detail using the voltage curve (Vt close curve) of the hexagonal shape as shown in FIG. 15. The voltage curve is employed as the discharge generation principle of a PDP and a method of measuring voltage margin.

In FIG. 15, the hexagonal region within the voltage curve is an area where the cell voltage within the discharge cell is moved. When the cell voltage is located in the internal hexagonal region, a discharge is not generated in this region. (i.e., when the cell voltage is located in the hexagonal external region, a discharge is generated.) In other words, the inside of the voltage curve is a non-discharge region where a discharge is not generated in the discharge cell. The outside of the voltage curve is a discharge region where a discharge is generated in the discharge cell. "Y(−)" indicates a direction where the cell voltage is moved when a negative (−) voltage is applied to the scan electrodes Y. In the same manner, each of "Y(+), X(+), X(−), Z(+) and Z(−)" indicates a direction where the cell voltage is moved when a negative (−) or positive (+) is applied to the scan electrodes Y, the address electrodes X and the sustain electrodes Z.

Furthermore, "Vtxy" in a quadrant 1 counter discharge region of the voltage curve graph indicates a voltage in which a discharge begins between the address electrodes X and the scan electrodes Y when the voltage is applied to the address electrodes X. Therefore, a straight line indicating the quadrant 1 counter discharge region of the voltage curve graph is decided as a length as much as a voltage in which a discharge begins between the address electrodes X and the scan electrodes Y. In addition, "Vtzy" in the quadrant 1 surface discharge region of the voltage curve graph indicates a voltage in which a discharge begins the sustain electrodes Z and the scan electrodes Y when the voltage is applied to the sustain electrodes Z. In the same manner, each of "Vtxz, Vtzx, Vtyz and Vtyx" indicates a discharge firing voltage between electrodes. Meanwhile, voltages of Vtxy, Vtzy, Vtxz, Vtzx, Vtyz, Vtyx, etc. are varied a little depending on a panel. The shape of a voltage curve is also varied a little depending on (a cell size, process deviation, etc.).

The driving operation of the on-cell control pulse (dp) is the same as that of the on-cell control pulse (dp) in the method of driving the PDP according to a second embodiment of the present. Description thereof will be omitted for simplicity.

Figure 16:
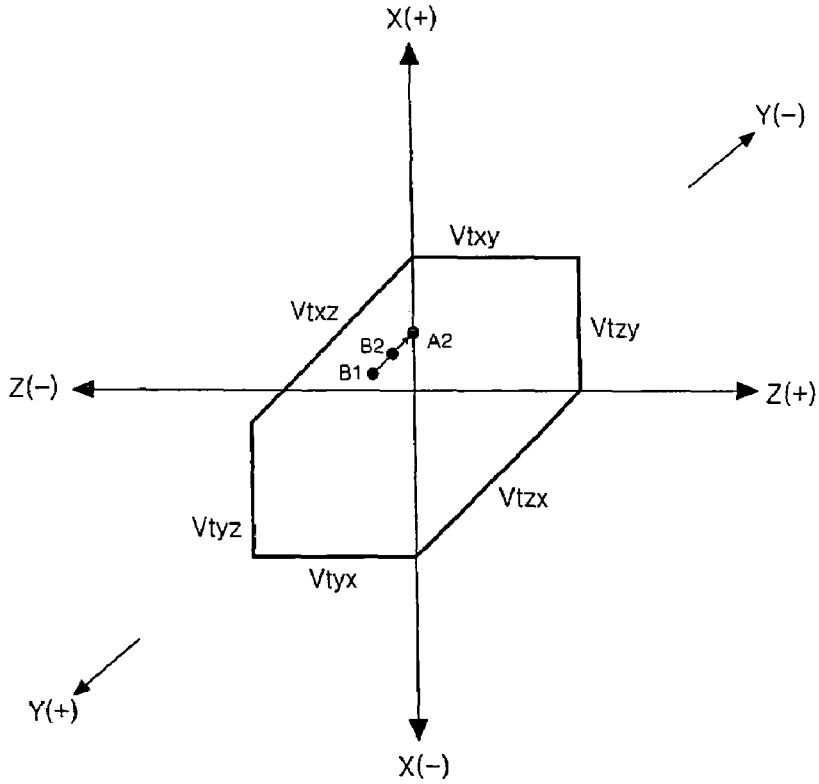
FIG. 16 is a view showing that a wall voltage of off-cells is moved by an off-cell control ramp waveform shown in FIG. 14.

After the on-cell control pulse (dp) is applied to the sustain electrodes Z at normal temperature (approximately from more than 10° C. to less than 40° C.), the wall voltage of the off-cells has not generated a sustain discharge. Therefore, the wall voltage of the off-cells has to maintain the location of the point A2 on the X(+) axis as shown in FIG. 15. However, if an image of high gray levels is represented in a state where a driving temperature or an ambient temperature of a PDP is high temperature (approximately 40° C. or higher), the wall voltage of the off-cells is lowered to a point B2 adjacent to the Z(−) axis, as shown in FIG. 15. At this time, in subfields that represent higher gray levels when a driving temperature or an ambient temperature of a PDP rises, the wall voltage of the off-cells is further lowered to a point B1 adjacent to the Z(−) axis. If an off-cell control ramp waveform (ssp) that rises with a slope from the sustain voltage (Vs) is applied to the scan electrodes Y in a reset period of an $n^{th}$ (n is an integer greater than 2) subfield of the remaining subfields other than a first subfield of one frame when the wall voltage of the off-cells is located at the point B1 (or B2), the wall voltage of the off-cells is moved from the point B1 (or B2) to the point A2, as shown in FIG. 16. In this case, in the off-cell control ramp waveform (ssp), a wall voltage of off-cells located at the point B1 (or B2) has an amount of the degree in which it can be moved to the point A2. The amount of the off-cell control ramp waveform (ssp) can be controlled by adjusting a rising time of the off-cell control ramp waveform (ssp) depending on a driving temperature or an ambient temperature of a PDP or an amount of gray levels to be represented.

In the method of driving the PDP according to the third embodiment of the present invention, as described above, after the sustain discharge, the on-cell control pulse (dp) is applied to the sustain electrodes Z. Furthermore, the off-cell control ramp waveform (ssp), which can be varied depending on a driving temperature or an ambient temperature of a PDP or an amount of gray levels to be represented, is applied to the scan electrodes Y in a reset period of an $n^{th}$ (n is an integer greater than 2) subfield of the remaining subfields other than a first subfield of one frame. Therefore, a PDP can be driven stably regardless of variation in ambient environment.

Figure 17:
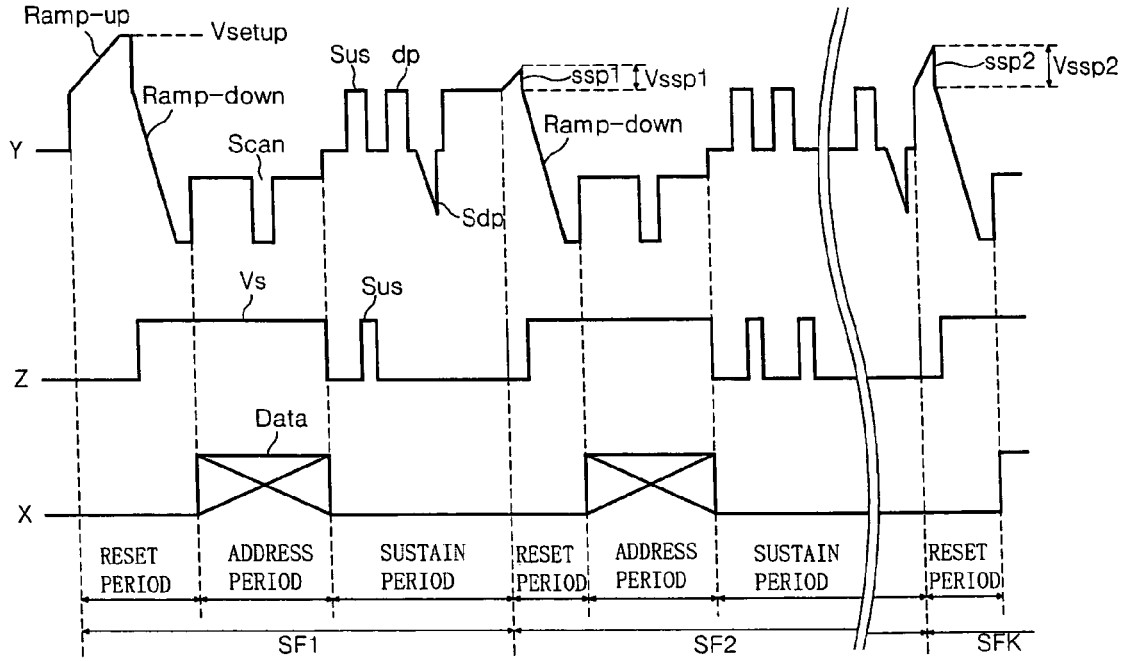
FIG. 17 shows a waveform for illustrating a method of driving a PDP according to a fourth embodiment of the present invention.

FIG. 17 shows a waveform for illustrating a method of driving a PDP according to a fourth embodiment of the present invention.

Referring to FIG. 17, in the method of driving the PDP according to a fourth embodiment of the present invention, the PDP is driven with one frame being divided into a number of subfields. Each of the sub fields is driven with it being divided into a reset period for initializing cells of the entire screen, an address period for selecting a cell, and a sustain period for sustaining the discharge of a selected cell.

In one frame, during a set-up period of the reset period of a first subfield, a ramp-up waveform (Ramp-up), which rises to a set-up voltage (Vsetup), is applied to scan electrodes Y at the same time. The ramp-up waveform (Ramp-up) generates a weak discharge (a set-up discharge) within the cells of the entire screen, so that wall charges are generated within the cells. The ramp-up waveform (Ramp-up) is applied to only the first subfield (SF1) of one frame. After the ramp-up waveform (Ramp-up) is applied, during a set-down period of the reset period, a ramp-down waveform (Ramp-down), which falls from a sustain voltage (Vs) lower than a peak voltage of the ramp-up waveform (Ramp-up), is applied to the scan electrodes Y at the same time. The ramp-down waveform (Ramp-down) generates a weak erase discharge within the cells, thus erasing unnecessary charges, such as wall charges generated by the set-up discharge and spatial discharges, and also causing wall charges necessary for an address discharge to uniformly remain within the cells.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within cells to which the data pulse (Data) has been applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the scan electrodes Y to when the address period is ended.

In the sustain period, a sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

Lastly, after the sustain discharge is completed, an on-cell ramp waveform (Sdp) (i.e., an assistant ramp-down waveform), which falls to a negative polarity (−) is applied to the scan electrodes Y. A width and amount of the on-cell ramp waveform (Sdp) can be varied depending on a driving temperature or an ambient temperature of a PDP or an amount of gray levels to be represented. The on-cell ramp waveform (Sdp) erases a desired amount of wall charges of discharge cells in which the sustain discharge has occurred. Due to this, a wall voltage of the discharge cells in which the sustain discharge has occurred is moved to a desired location. This will be described in detail later on.

After the on-cell ramp waveform (Sdp) (i.e., an assistant ramp-down waveform) is applied, an off-cell control ramp waveform (ssp) is applied to the scan electrodes Y in a reset period of an $n^{th}$ (n is an integer greater than 2) subfield of the remaining subfields other than the first subfield of one frame. In this case, a positive (+) sustain voltage (Vs) is applied to the scan electrodes Y in a reset period of a subfield in which the off-cell control ramp waveform (ssp) has not been applied, of the remaining subfields other than the first subfield of one frame. At this time, the off-cell control ramp waveform (ssp) (i.e., an assistant ramp-down waveform) is set as a ramp waveform that gradually rises from the sustain voltage (Vs) and has a different voltage value depending on a driving temperature or an ambient temperature of a PDP or an amount of gray levels to be represented. In other words, variation in a characteristic of off-cells is different in subfields that represent high gray levels when a driving temperature or an ambient temperature of a PDP is changed. Therefore, the off-cell control ramp waveform (ssp) having a different peak voltage is applied to the scan electrodes Y in a reset period of an $n^{th}$ (n is an integer greater than 2) subfield of the remaining subfields other than the first subfield of one frame. The peak voltage of the off-cell control ramp waveform (ssp) is higher as subfields represent higher gray levels, but has the same slope regardless of a peak voltage value. In other words, a peak voltage of an off-cell control ramp waveform (sspk), which is applied to the scan electrodes Y in a reset period of a last subfield of one frame, is higher than that of a first off-cell control ramp waveform (ssp1), which is applied to the scan electrodes Y in a reset period of an $n^{th}$ (n is an integer greater than 2) subfield of the remaining subfields other than the first subfield of one frame. The peak voltage value of the off-cell control ramp waveform (ssp) can be controlled by adjusting a rising time of the off-cell control ramp waveform (ssp). Due to this, a wall voltage of the off-cells can be moved to a desired location without respect to a driving temperature or an ambient temperature of a PDP or an amount of gray levels to be represented. This will be described in detail later on. Meanwhile, a peak voltage value (Vssp) of the off-cell control ramp waveform (ssp) can be set to a range in which a wall voltage of off-cells can be moved to a desired location during a set-down period, e.g., from approximately 0V (Vs) to a set-up voltage (Vsetup). While the off-cell control ramp waveform (ssp) is applied to the scan electrodes Y, a ground voltage (GND) is applied to the sustain electrodes Z so that the wall voltage of the off-cells can be stably located at a desired location.

The address period and the sustain period of the second subfield are the same as those of the method of driving the PDP according to a second embodiment of the present invention. Description thereof will be omitted.

Practically, in the method of driving the PDP according to a fourth embodiment of the present invention, a predetermined image is displayed while the above process is repeated. That is, in the method of driving the PDP according to a fourth embodiment of the present invention, the ramp-up waveform (Ramp-up) having the set-up voltage (Vstup) is supplied only during the reset period of the first subfield of one frame. Therefore, not only contrast can be improved, but also power consumption can be saved. Furthermore, in the method of driving the PDP according to a fourth embodiment of the present invention, a PDP is controlled so that it can be driven stably using the on-cell control ramp waveform (Sdp) (i.e., an assistant ramp-down waveform) and the off-cell control ramp waveform (ssp) (i.e., an assistant ramp-down waveform) although the ramp-up waveform (Ramp-down) is not applied. In addition, in the method of driving the PDP according to a fourth embodiment of the present invention, the off-cell control ramp waveform (ssp) having a different peak voltage is applied to the scan electrodes Y depending on a driving temperature or an ambient temperature of a PDP or an amount of gray levels to be represented in a reset period of an $n^{th}$ (n is an integer greater than 2) subfield of the remaining subfields other than a first subfield of one frame. Therefore, not only a PDP can be driven stably regardless of variation in ambient environment, but also a high contrast image ca be displayed.

Figure 18:
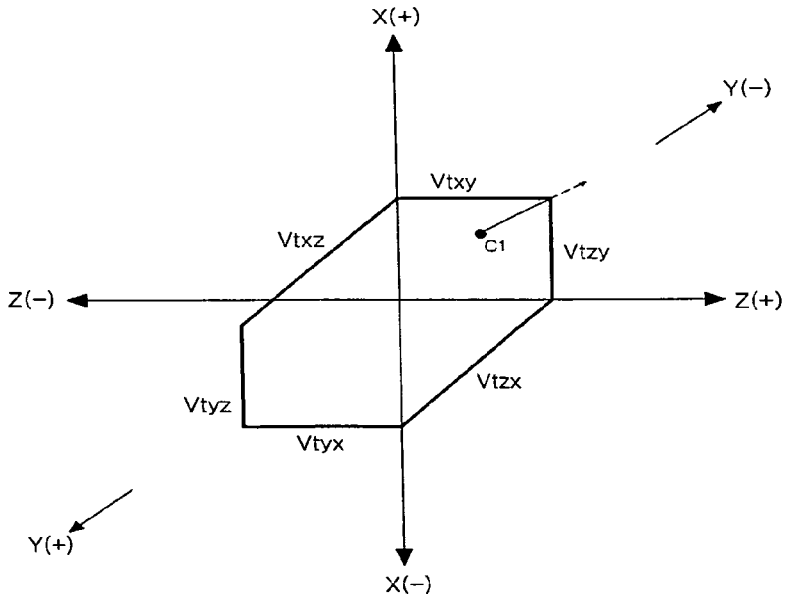
FIG. 18 is a view showing that a cell voltage of off-cells is moved by an on-cell control ramp waveform shown in FIG. 17.

The operating principle of the on-cell control ramp waveform (Sdp) and the off-cell control ramp waveform (ssp) will be describe in detail using the voltage curve (Vt close curve) of the hexagonal shape as shown in FIG. 18. The voltage curve is employed as the discharge generation principle of a PDP and a method of measuring voltage margin.

In FIG. 18, the hexagonal region within the voltage curve is an area where the cell voltage within the discharge cell is moved. When the cell voltage is located in the internal hexagonal region, a discharge is not generated in this region. (i.e., when the cell voltage is located in the hexagonal external region, a discharge is generated.) In other words, the inside of the voltage curve is a non-discharge region where a discharge is not generated in the discharge cell. The outside of the voltage curve is a discharge region where a discharge is generated in the discharge cell. "Y(−)" indicates a direction where the cell voltage is moved when a negative (−) voltage is applied to the scan electrodes Y. In the same manner, each of "Y(+), X(+), X(−), Z(+) and Z(−)" indicates a direction where the cell voltage is moved when a negative (−) or positive (+) is applied to the scan electrodes Y, the address electrodes X and the sustain electrodes Z.

Furthermore, "Vtxy" in a quadrant 1 counter discharge region of the voltage curve graph indicates a voltage in which a discharge begins between the address electrodes X and the scan electrodes Y when the voltage is applied to the address electrodes X. Therefore, a straight line indicating the quadrant 1 counter discharge region of the voltage curve graph is decided as a length as much as a voltage in which a discharge begins between the address electrodes X and the scan electrodes Y. In addition, "Vtzy" in the quadrant 1 surface discharge region of the voltage curve graph indicates a voltage in which a discharge begins the sustain electrodes Z and the scan electrodes Y when the voltage is applied to the sustain electrodes Z. In the same manner, each of "Vtxz, Vtzx, Vtyz and Vtyx" indicates a discharge firing voltage between electrodes. Meanwhile, voltages of Vtxy, Vtzy, Vtxz, Vtzx, Vtyz, Vtyx, etc. are varied a little depending on a panel. The shape of a voltage curve is also varied a little depending on (a cell size, process deviation, etc.).

Figure 19:
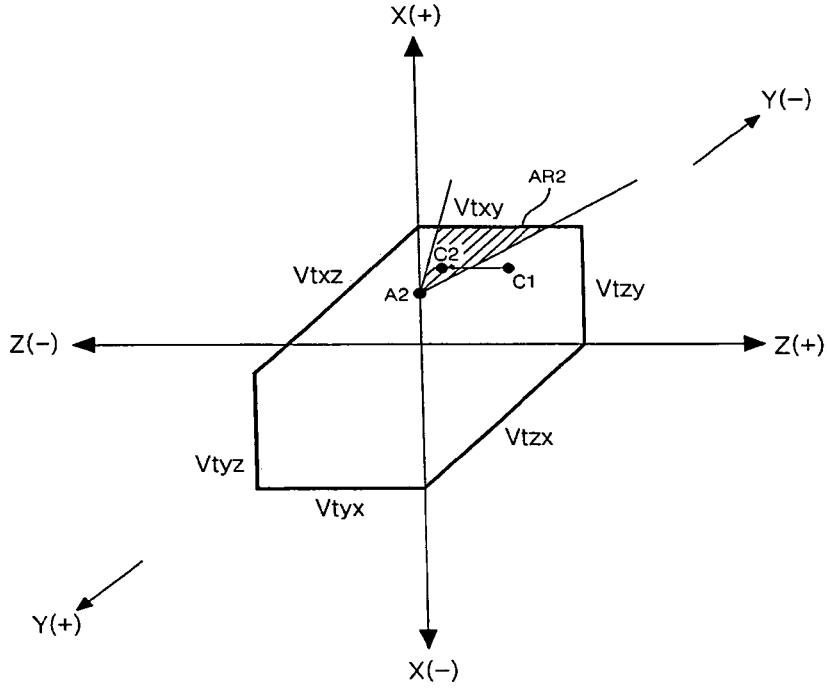
FIG. 19 is a view showing that a wall voltage of off-cells is moved by the on-cell control ramp waveform shown in FIG. 17.
Figure 20:
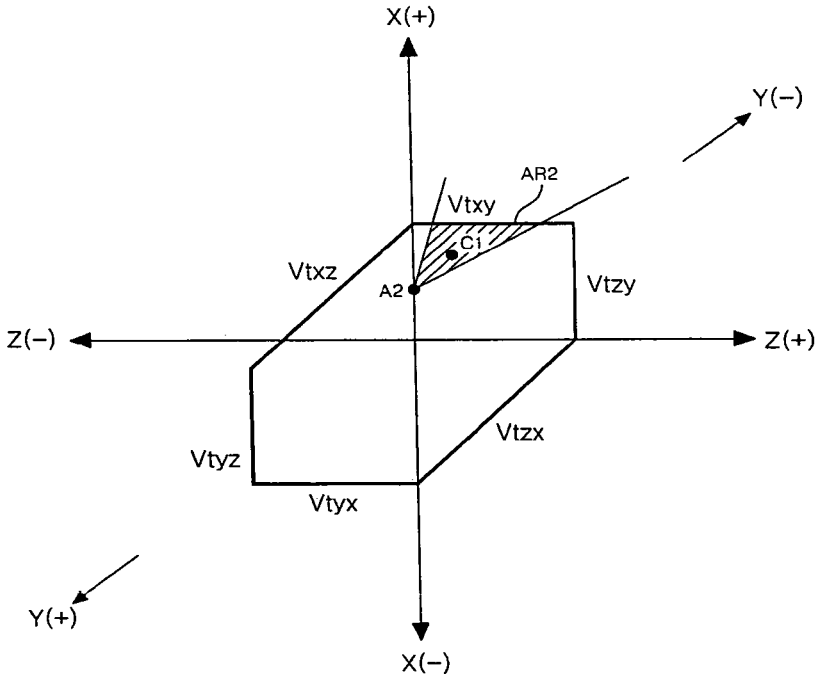
FIG. 20 is a view showing that a wall voltage of on-cells is located at an wanted location by the on-cell control ramp waveform shown in FIG. 17.

After the sustain discharge of the first subfield of one frame is completed, a wall voltage of the on-cells is located at a point C1 of the quadrant 1 of the voltage curve graph, as shown in FIG. 18 (i.e., a last sustain pulse (Sus) is applied to the scan electrodes Y). Thereafter, if the on-cell ramp waveform (Sdp) that falls to a negative polarity (−) is applied to the scan electrodes Y, a cell voltage of the on-cells is moved via a surface discharge region of the quadrant 1 of the voltage curve graph (i.e., toward the Y(−) side) and a weak discharge is generated within the discharge cells. At this time, a peak voltage of the on-cell ramp waveform (Sdp) has a different width and amount depending on a wall voltage of an on-cell location and has a different slope depending on an amount of a peak voltage value. The width of the on-cell ramp waveform (Sdp) can be different depending on the peak voltage value of the on-cell ramp waveform (Sdp). In other words, if the point C1 where the wall voltage of the on-cells is located depending on a driving temperature or an ambient temperature of a PDP or an amount of gray levels to be represented is a point located outside an off-cell convergence area (AR2), as shown in FIG. 19, the on-cell ramp waveform (Sdp) has a high peak voltage value of the degree in which the wall voltage of the on-cells located at the point C1 outside the off-cell convergence area (AR2) can be moved to a point C2 within the off-cell convergence area (AR2). That is, the on-cell ramp waveform (Sdp) not only has a high peak voltage value as a driving temperature or an ambient temperature of a PDP is increased, but also has a high peak voltage value as an amount of gray levels to be represented in each subfield is increased. However, if the point C1 where the wall voltage of the on-cells is located is a point located within the off-cell convergence area (AR2) as shown in FIG. 20, an amount of the on-cell ramp waveform (Sdp) has a low peak voltage value of the degree in which the wall voltage of the on-cells does not deviate from the inside of the off-cell convergence area (AR2). Therefore, the wall voltage of the on-cells can be located at a desired point regardless of a driving temperature or an ambient temperature of a PDP or an amount of gray levels to be represented. In other words, the wall voltage of the on-cells can be moved to a point where the discharge cells can be stably initialized in a reset period of a next subfield by controlling the on-cell ramp waveform (Sdp) to have a different value depending on a driving temperature or an ambient temperature of a PDP or an amount of gray levels to be represented.

Thereafter, the driving operation of the off-cell control ramp waveform (ssp), which is applied to the scan electrodes Y in a reset period of an $n^{th}$ (n is an integer greater than 2) subfield of the remaining subfields other than the first subfield of one frame, is the same as that of the method of driving the PDP according to a third embodiment of the present invention. Description thereof will be omitted for simplicity.

In the method of driving the PDP according to a fourth embodiment of the present invention, after a sustain discharge is completed in each off the subfields as described above, the on-cell ramp waveform (Sdp) (i.e., an assistant ramp-down waveform), which falls to a negative polarity (−), is applied to the scan electrodes Y and the off-cell control ramp waveform (ssp), which can be varied depending on a driving temperature or an ambient temperature of a PDP or an amount of gray levels to be represented, is applied to the scan electrodes Y in a reset period of an $n^{th}$ (n is an integer greater than 2) subfield of the remaining subfields other than the first subfield of one frame. Therefore, a PDP can be driven stably without respect to variation in ambient environment.

Figure 21:
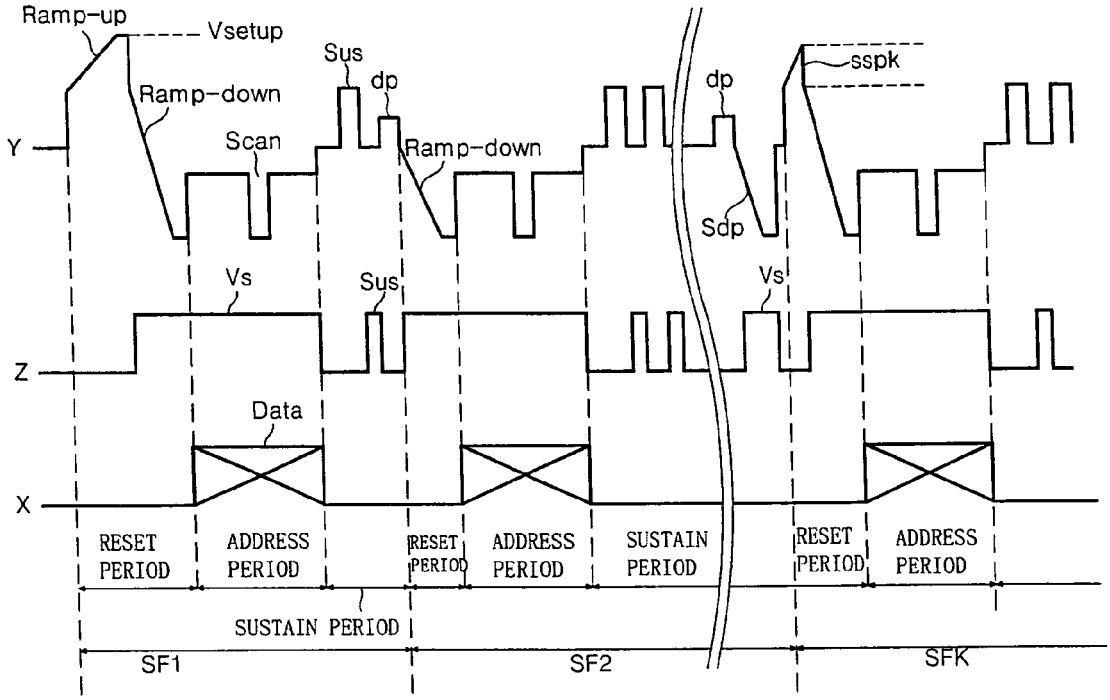
FIG. 21 shows a waveform for illustrating a method of driving a PDP according to a fifth embodiment of the present invention.

FIG. 21 shows a waveform for illustrating a method of driving a PDP according to a fifth embodiment of the present invention.

Referring to FIG. 21, in the method of driving the PDP according to a fifth embodiment of the present invention, the PDP is driven with one frame being divided into a number of subfields. Each of the sub fields is driven with it being divided into a reset period for initializing cells of the entire screen, an address period for selecting a cell, and a sustain period for sustaining the discharge of a selected cell.

In one frame, during a set-up period of the reset period of a first subfield, a ramp-up waveform (Ramp-up), which rises to a set-up voltage (Vsetup), is applied to scan electrodes Y at the same time. The ramp-up waveform (Ramp-up) generates a weak discharge (a set-up discharge) within the cells of the entire screen, so that wall charges are generated within the cells. The ramp-up waveform (Ramp-up) is applied to only the first subfield (SF1) of one frame. After the ramp-up waveform (Ramp-up) is applied, during a set-down period of the reset period, a ramp-down waveform (Ramp-down), which falls from a sustain voltage (Vs) lower than a peak voltage of the ramp-up waveform (Ramp-up), is applied to the scan electrodes Y at the same time. The ramp-down waveform (Ramp-down) generates a weak erase discharge within the cells, thus erasing unnecessary charges, such as wall charges generated by the set-up discharge and spatial discharges, and also causing wall charges necessary for an address discharge to uniformly remain within the cells.

In the address period, while a negative (−) scan pulse (Scan) is sequentially applied to the scan electrodes Y, a positive (+) data pulse (Data) is applied to the address electrodes X. As a voltage difference between the scan pulse (Scan) and the data pulse (Data) and a wall voltage generated in the reset period are added, an address discharge is generated within cells to which the data pulse (Data) has been applied. Predetermined wall charges are generated within cells selected by the address discharge.

Meanwhile, a positive (+) sustain voltage (Vs) is applied to the sustain electrodes Z from when the ramp-down waveform (Ramp-down) is applied to the scan electrodes Y to when the address period is ended.

In the sustain period, a sustain pulse (Sus) is alternately applied to the scan electrodes Y and the sustain electrodes Z. A sustain discharge is generated in surface discharge form between the scan electrodes Y and the sustain electrodes Z in cells selected by the address discharge whenever the sustain pulse (Sus) is applied as the wall voltage within the cell and the sustain pulse (Sus) are added. The number of the sustain pulse (Sus) applied during the sustain period can be set corresponding to a luminance weight of each frame.

Lastly, after the sustain discharge is completed, an on-cell control pulse (dp) of a first polarity (i.e., a positive polarity (+)), which has a voltage value lower than the sustain voltage (Vs), is applied to the scan electrodes Y. The on-cell control pulse (dp) generates a primary erase discharge to erase spatial charges remaining within cells of the entire screen, which are formed by the sustain discharge. Due to this, a wall voltage of the discharge cells in which the sustain discharge has occurred is moved to a desired location. This will be described in detail later on.

After the on-cell control pulse (dp) is applied to the scan electrodes Y, an on-cell ramp waveform (Sdp) (i.e., an assistant ramp-down waveform), which falls to a second polarity (i.e., a negative polarity (−)), is applied to the scan electrodes Y. The on-cell ramp waveform (Sdp) is applied to the scan electrodes Y after the on-cell control pulse (dp) is applied in a sustain period of a previous subfield when an off-cell control ramp waveform (ssp) is applied in a reset period of an $n^{th}$ (n is an integer greater than 2) subfield of the remaining subfields other than a first subfield of one frame. In other words, the on-cell ramp waveform (Sdp) is not applied in subfields in which a PDP is stably driven regardless of a driving temperature or an ambient temperature of a PDP or an amount of gray levels to be represented. Therefore, in subfields in which the on-cell ramp waveform (Sdp) has not been applied, after the on-cell control pulse (dp) is applied to the scan electrodes Y, the ramp-down waveform (Ramp-down) is applied to the scan electrodes Y. At this time, a width and amount of the on-cell ramp waveform (Sdp) may be varied depending on a driving temperature or an ambient temperature of a PDP or an amount of gray levels to be represented. If the on-cell ramp waveform (Sdp) is applied to the scan electrodes Y, it generates a secondary erase discharge to completely remove unnecessary spatial charges and wall charges, which remain after the primary erase discharge by the on-cell control pulse (dp). Therefore, the wall voltage of the on-cells can be moved to a desired location. This will be described in detail later on.

After the on-cell ramp waveform (Sdp) (i.e., an assistant ramp-down waveform) is applied to the scan electrodes Y, an off-cell control ramp waveform (ssp) (i.e., an assistant ramp-down waveform) is applied to the scan electrodes Y in a reset period of an $n^{th}$ (n is an integer greater than 2) subfield of the remaining subfields other than the first subfield of one frame. At this time, the off-cell control ramp waveform (ssp) is set as a ramp waveform, which gradually rises from the sustain voltage (Vs), and has a different voltage value depending on a driving temperature or an ambient temperature of a PDP or an amount of gray levels to be represented. In other words, variation in a characteristic of off-cells is different in subfields that represent high gray levels when a driving temperature or an ambient temperature of a PDP is changed. Therefore, the off-cell control ramp waveform (ssp) having a different peak voltage is applied to the scan electrodes Y in a reset period of an $n^{th}$ (n is an integer greater than 2) subfield of the remaining subfields other than the first subfield of one frame. The peak voltage of the off-cell control ramp waveform (ssp) is higher as subfields represent higher gray levels, but has the same slope regardless of a peak voltage value. In other words, a peak voltage of an off-cell control ramp waveform (sspk), which is applied to the scan electrodes Y in a reset period of a last subfield of one frame, is higher than that of a first off-cell control ramp waveform (ssp1), which is applied to the scan electrodes Y in a reset period of an $n^{th}$ (n is an integer greater than 2) subfield of the remaining subfields other than the first subfield of one frame. The peak voltage value of the off-cell control ramp waveform (ssp) can be controlled by adjusting a rising time of the off-cell control ramp waveform (ssp). Due to this, a wall voltage of the off-cells can be moved to a desired location without respect to a driving temperature or an ambient temperature of a PDP or an amount of gray levels to be represented. This will be described in detail later on. Meanwhile, a peak voltage value (Vssp) of the off-cell control ramp waveform (ssp) can be set to a range in which a wall voltage of off-cells can be moved to a desired location during a set-down period, e.g., from approximately 0V (Vs) to a set-up voltage (Vsetup). While the off-cell control ramp waveform (ssp) is applied to the scan electrodes Y, a ground voltage (GND) is applied to the sustain electrodes Z so that the wall voltage of the off-cells can be stably located at a desired location.

The address period and the sustain period of the remaining subfields other than the first subfield of one frame are the same as those of the method of driving the PDP according to a second embodiment of the present invention. Description thereof will be omitted.

Practically, in the method of driving the PDP according to a fifth embodiment of the present invention, a predetermined image is displayed while the above process is repeated. That is, in the method of driving the PDP according to a fifth embodiment of the present invention, the ramp-up waveform (Ramp-up) having the set-up voltage (Vstup) is supplied only during the reset period of the first subfield of one frame. Therefore, not only contrast can be improved, but also power consumption can be saved. Furthermore, in the method of driving the PDP according to a fifth embodiment of the present invention, a PDP is controlled so that it can be driven stably using the on-cell control pulse (dp) and the off-cell control ramp waveform (ssp) although the ramp-up waveform (Ramp-down) is not applied. In addition, in the method of driving the PDP according to a fifth embodiment of the present invention, the off-cell control ramp waveform (ssp) having a different peak voltage is applied to the scan electrodes Y depending on a driving temperature or an ambient temperature of a PDP or an amount of gray levels to be represented in a reset period of an $n^{th}$ (n is an integer greater than 2) subfield of the remaining subfields other than a first subfield of one frame. Therefore, not only a PDP can be driven stably regardless of variation in ambient environment, but also a high contrast image ca be displayed.

The operating principle of the on-cell control pulse (dp) and the off-cell control ramp waveform (ssp) will be describe in detail using the voltage curve (Vt close curve) of the hexagonal shape as shown in FIG. 18. The voltage curve is employed as the discharge generation principle of a PDP and a method of measuring voltage margin.

Figure 22:
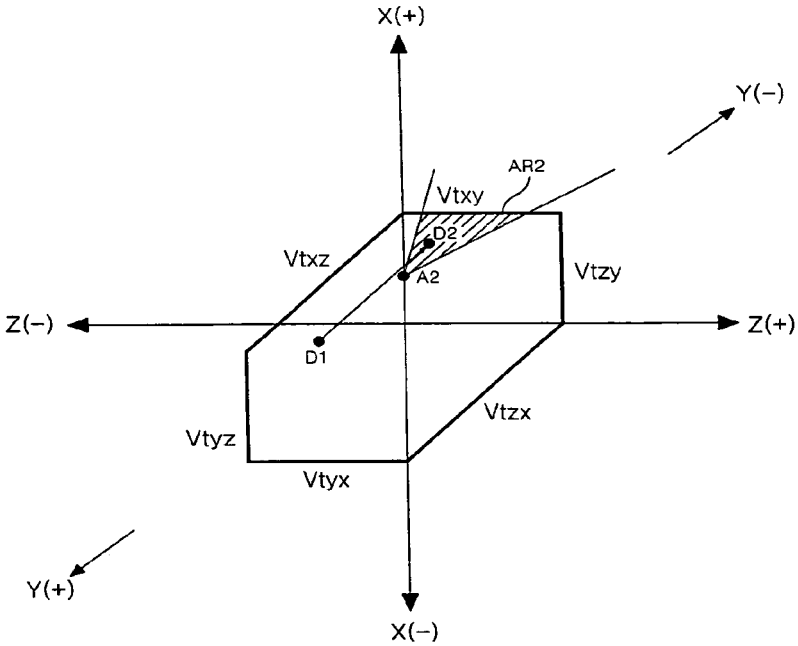
FIG. 22 is a view showing that a wall voltage of on-cells is moved by an on-cell control pulse shown in FIG. 21.

In FIG. 22, the hexagonal region within the voltage curve is an area where the cell voltage within the discharge cell is moved. When the cell voltage is located in the internal hexagonal region, a discharge is not generated in this region. (i.e., when the cell voltage is located in the hexagonal external region, a discharge is generated.) In other words, the inside of the voltage curve is a non-discharge region where a discharge is not generated in the discharge cell. The outside of the voltage curve is a discharge region where a discharge is generated in the discharge cell. "Y(−)" indicates a direction where the cell voltage is moved when a negative (−) voltage is applied to the scan electrodes Y. In the same manner, each of "Y(+), X(+), X(−), Z(+) and Z(−)" indicates a direction where the cell voltage is moved when a negative (−) or positive (+) is applied to the scan electrodes Y, the address electrodes X and the sustain electrodes Z.

Furthermore, "Vtxy" in a quadrant 1 counter discharge region of the voltage curve graph indicates a voltage in which a discharge begins between the address electrodes X and the scan electrodes Y when the voltage is applied to the address electrodes X. Therefore, a straight line indicating the quadrant 1 counter discharge region of the voltage curve graph is decided as a length as much as a voltage in which a discharge begins between the address electrodes X and the scan electrodes Y. In addition, "Vtzy" in the quadrant 1 surface discharge region of the voltage curve graph indicates a voltage in which a discharge begins the sustain electrodes Z and the scan electrodes Y when the voltage is applied to the sustain electrodes Z. In the same manner, each of "Vtxz, Vtzx, Vtyz and Vtyx" indicates a discharge firing voltage between electrodes. Meanwhile, voltages of Vtxy, Vtzy, Vtxz, Vtzx, Vtyz, Vtyx, etc. are varied a little depending on a panel. The shape of a voltage curve is also varied a little depending on (a cell size, process deviation, etc.).

Figure 23:
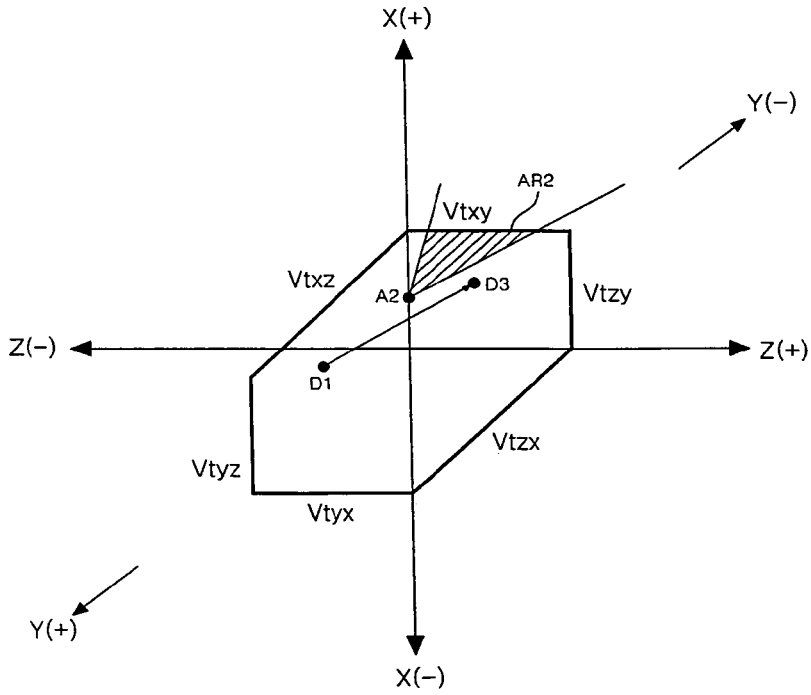
FIG. 23 is a view showing that a wall voltage of on-cells is located to an unwanted location due to a particular cause.
Figure 24:
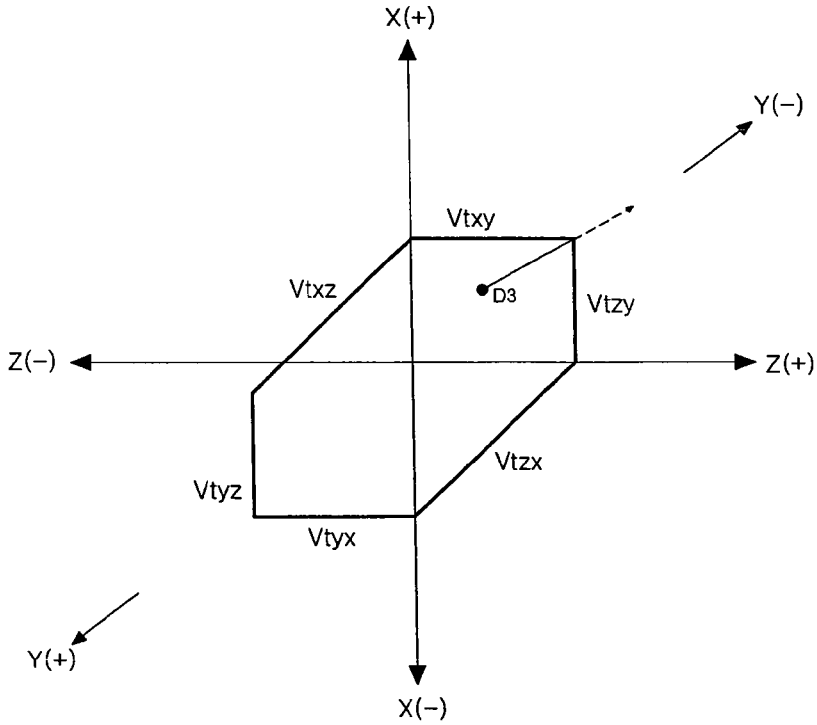
FIG. 24 is a view showing that a cell voltage of on-cells is moved by an on-cell control ramp waveform shown in FIG. 21.
Figure 25:
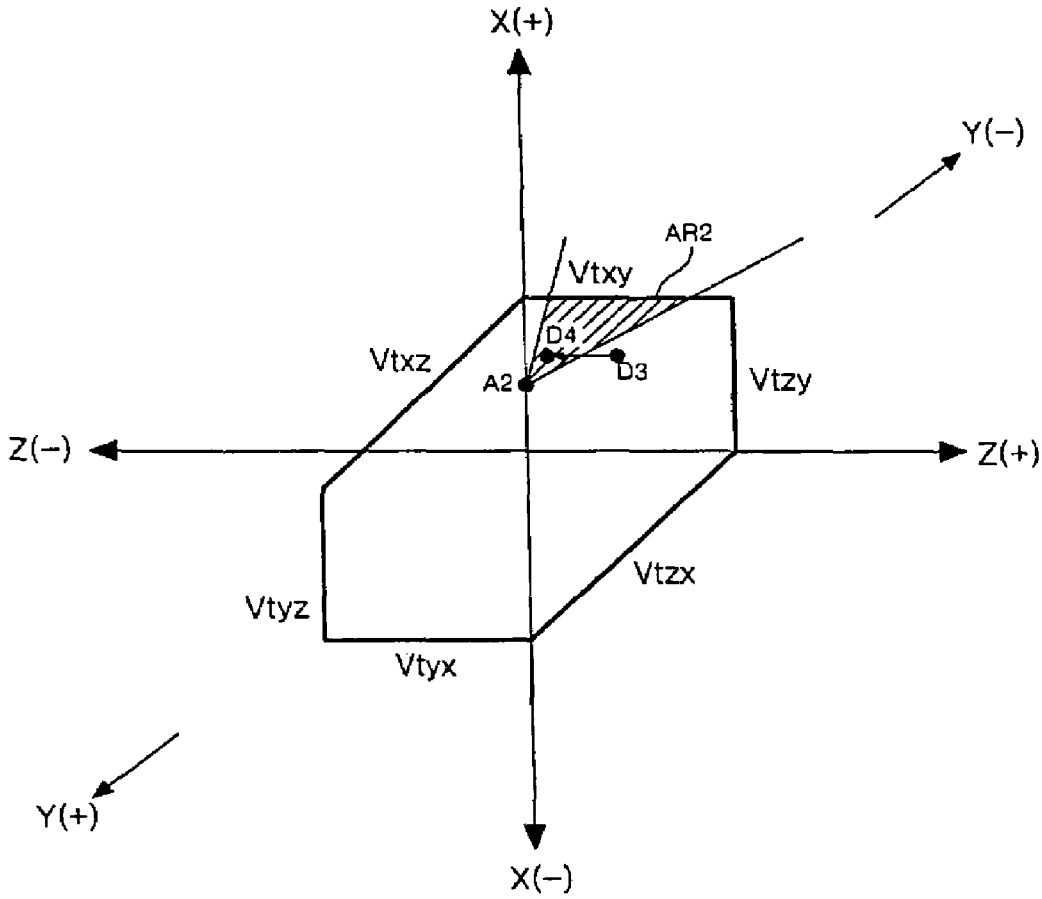
FIG. 25 is a view showing that a wall voltage of on-cells is moved by the on-cell control ramp waveform shown in FIG. 21.

After the sustain discharge of the first subfield of one frame is completed, a wall voltage of the on-cells is located at a point D1 of the quadrant 3 of the voltage curve graph, as shown in FIG. 22 (i.e., a last sustain pulse (Sus) is applied to the scan electrodes Y). Thereafter, if an on-cell control pulse (dp) having a voltage value lower than the sustain voltage (Vs) is applied to the scan electrodes Y, a cell voltage of the on-cells is moved via a surface discharge region of the quadrant 3 of the voltage curve graph (i.e., moved toward the Y(+) side) and a weak discharge is generated within the discharge cells. Therefore, the wall voltage of the on-cells is moved from the point D1 of the quadrant 3 to a point D2 within an off-cell convergence area (AR2), as shown in FIG. 22. However, the wall voltage of the on-cells is moved from the point D1 of the quadrant 3 to a point D3 outside the off-cell convergence area (AR2) depending on a driving temperature or an ambient temperature of a PDP or an amount of gray levels to be represented, as shown in FIG. 23. At this time, if the on-cell ramp waveform (Sdp) that falls to a negative polarity (−) is applied to the scan electrodes Y, a cell voltage of the on-cells is moved via a surface discharge region of the quadrant 1 of the voltage curve graph (i.e., moved toward the Y(−) side), as shown in FIG. 24 and a weak discharge is generated within the discharge cells. Due to this, the wall voltage of the on-cells is moved from the point D3 located outside the off-cell convergence area (AR2) to a point D4 within the off-cell convergence area (AR2), as shown in FIG. 25. At this time, the on-cell ramp waveform (Sdp) has a peak voltage value of the degree in which the wall voltage of the on-cells can be moved into the off-cell convergence area (AR2). Therefore, initialization can be performed stably in discharge cells of a reset period of a next subfield.

Thereafter, the driving operation of the off-cell control ramp waveform (ssp), which is applied to the scan electrodes Y in a reset period of an $n^{th}$ (n is an integer greater than 2) subfield of the remaining subfields other than the first subfield of one frame, is the same as that of the method of driving the PDP according to a third embodiment of the present invention. Description thereof will be omitted for simplicity.

In the method of driving the PDP according to a fifth embodiment of the present invention, after a sustain discharge is completed in each off the subfields as described above, an on-cell control pulse (dp) having a voltage value lower than the sustain voltage (Vs) is applied to the scan electrodes Y and the off-cell control ramp waveform (ssp), which can be varied depending on a driving temperature or an ambient temperature of a PDP or an amount of gray levels to be represented, is applied to the scan electrodes Y in a reset period of an $n^{th}$ (n is an integer greater than 2) subfield of the remaining subfields other than the first subfield of one frame. Therefore, a PDP can be driven stably without respect to variation in ambient environment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a scan electrode:

a sustain electrode; and a controller for applying a rising waveform and a falling waveform to the scan electrode in a reset period of a first subfield of a frame and the controller for applying another falling waveform to the scan electrode when a first time elapses, after a first sustain voltage is applied to the scan electrode during a sustain period of the first subfield, wherein a second sustain voltage is applied to the sustain electrode during the sustain period when a second time elapses after the first sustain voltage is applied, wherein the first sustain voltage and the second sustain voltage are continuously applied at an end of the sustain period of the first subfield, wherein the controller is adapted to apply a sub rising waveform, which rises from the first sustain voltage, to the scan electrode between an application time point of the first sustain voltage and an application time point of the other falling waveform, wherein a peak voltage value of the sub rising waveform is different from a peak voltage value of the sub rising waveform in other subfields, and wherein the sub rising waveform has a higher peak voltage value in higher grey level subfields.

2. The plasma display apparatus as claimed in claim 1, wherein the first time is greater than the second time.

3. The plasma display apparatus as claimed in claim 1, wherein the second sustain voltage is applied to the sustain electrode until an end of an address period in a second subfield that follows the first subfield.

4. The plasma display apparatus as claimed in claim 1, wherein the sub rising waveform is applied to the scan electrode at an end time point of application of the second sustain voltage.

5. The plasma display apparatus as claimed in claim 1, wherein a voltage level of the first sustain voltage is less than a voltage level of a sustain pulse.

6. The plasma display apparatus as claimed in claim 1, wherein a peak voltage value of the sub rising waveform is less than a peak voltage value of the rising waveform of the reset period.

7. A plasma display apparatus, comprising:

a scan electrode:

a sustain electrode; and a controller for applying a rising waveform and a falling waveform to the scan electrode in a reset period of a first subfield of a frame and applying the falling waveform to the scan electrode when a first time elapses, after a first sustain voltage is applied to the scan electrode during a sustain period, wherein the sustain electrode is applied with a second sustain voltage when a second time elapses, after the first sustain voltage is applied, wherein the controller is adapted to apply a sub rising waveform, which rises from the first sustain voltage, to the scan electrode between an application time point of the first sustain voltage and an application time point of the falling waveform, and wherein a peak voltage value of the sub rising waveform is different from a peak voltage value of the sub rising waveform in other subfields.

8. The plasma display apparatus as claimed in claim 7, wherein the sub rising waveform has a greater peak voltage value in higher gray level sub fields.

9. The plasma display apparatus as claimed in claim 7, wherein the sub rising waveform has a greater peak voltage value as a temperature of plasma display panel becomes higher.

10. The plasma display apparatus as claimed in claim 1, wherein the controller is adapted to apply an additional sub rising waveform to the scan electrode and a slope of the sub rising waveform is substantially same as a slope of the additional sub rising waveform.

11. The plasma display apparatus as claimed in claim 1, wherein the controller is adapted to apply a sub falling waveform to the scan electrode between an application time point of the first sustain voltage and a previous sustain pulse.

12. The plasma display apparatus as claimed in claim 11, wherein the controller is adapted to apply a sub rising waveform that rises from the first sustain voltage to the scan electrode between the application time point of the first sustain voltage and an application time point of the falling waveform in a second subfield.

13. A plasma display apparatus comprising:

a scan electrode:

a sustain electrode; and a controller for applying a rising waveform and a falling waveform to the scan electrode in a reset period of a first subfield of a frame and the controller for applying a falling waveform to the scan electrode when a first time elapses, after a first sustain voltage is applied to the scan electrode during a sustain period of the first subfield, and the controller for applying a sub falling waveform to the scan electrode between an application starting point of the first sustain voltage and a last sustain pulse applied to the scan electrode during the sustain period, wherein the first sustain voltage is continuously applied to the scan electrode at an end of the sustain period, wherein a voltage level of the sub falling waveform falls below a ground voltage level of the scan electrode, wherein the controller is adapted to apply a sub rising waveform, which rises from the first sustain voltage, to the scan electrode between an application time point of the first sustain voltage and an application time point of a falling waveform in a second subfield, wherein a peak voltage value of the sub rising waveform is different from a peak voltage value of the sub rising waveform in other subfields, and wherein the sub rising waveform has a higher peak voltage value in higher grey level subfields.

14. A method of driving a PDP, the method comprising:

applying a rising waveform and a falling waveform to a scan electrode in a reset period of a first subfield of a frame;

applying a falling waveform to the scan electrode when a first time elapses, after a first sustain voltage is applied to the scan electrode during a sustain period of the first subfield;

applying, during the sustain period of the first subfield, a second sustain voltage to the sustain electrode when a second time elapses, after the first sustain voltage is applied to the scan electrode, wherein the first sustain voltage and the second sustain voltage are continuously applied at an end of the sustain period; and applying a sub rising waveform, which rises from the first sustain voltage, to the scan electrode between an application time point of the first sustain voltage and an application time point of a falling waveform in a second subfield, wherein a peak voltage value of the sub rising waveform is different from a peak voltage value of the sub rising waveform in other sub fields, and wherein the sub rising waveform has a higher peak voltage value in higher grey level subfields.

15. The method as claimed in claim 14, wherein the first time is greater than the second time.

16. A method for driving a plasma display panel, comprising:

applying a rising waveform and a falling waveform to a scan electrode in a reset period of a first subfield of a frame;

applying the falling waveform to the scan electrode when a first time elapses, after a first sustain voltage is applied to the scan electrode during a sustain period; and applying a second sustain voltage to the sustain electrode when a second time elapses, after the first sustain voltage is applied, wherein the scan electrode is applied with a sub rising waveform that rises from the first sustain voltage between an application time point of the first sustain voltage and an application time point of the falling waveform, and wherein a peak voltage value of the sub rising waveform is different from a peak voltage value of the sub rising waveform in other sub fields.

17. The method as claimed in claim 14, wherein the scan electrode is applied with a sub falling waveform between an application time point of the first sustain voltage and a previous sustain pulse.

* * * * *